US007841120B2

(12) United States Patent
Teetzel et al.

(10) Patent No.: US 7,841,120 B2
(45) Date of Patent: Nov. 30, 2010

(54) HAND GRIP APPARATUS FOR FIREARM

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 904 days.

(21) Appl. No.: 11/651,743

(22) Filed: Jan. 10, 2007

(65) Prior Publication Data

US 2010/0242332 A1 Sep. 30, 2010

(51) Int. Cl.
*F41C 23/00* (2006.01)

(52) U.S. Cl. ..... 42/72

(58) Field of Classification Search ..... 42/72, 42/94

See application file for complete search history.

(56) References Cited

U.S. PATENT DOCUMENTS

| | | | | |
|---|---|---|---|---|
| 3,811,008 | A | 5/1974 | Lee | |
| 3,868,640 | A | 2/1975 | Binnie et al. | |
| 4,217,588 | A | 8/1980 | Freeny, Jr. | |
| 4,281,354 | A | 7/1981 | Conte | |
| 4,303,910 | A | 12/1981 | McCann | |
| 4,385,231 | A | 5/1983 | Mizutani et al. | |
| 4,449,189 | A | 5/1984 | Feix et al. | |
| 4,458,266 | A | 7/1984 | Mahoney | |
| 4,459,474 | A | 7/1984 | Walton | |
| 4,471,345 | A | 9/1984 | Barrett, Jr. | |
| 4,528,663 | A | 7/1985 | Citta | |
| 4,533,980 | A * | 8/1985 | Hayes | 362/110 |
| 4,598,275 | A | 7/1986 | Ross et al. | |
| 4,654,793 | A | 3/1987 | Elrod | |
| 4,656,463 | A | 4/1987 | Anders et al. | |

(Continued)

FOREIGN PATENT DOCUMENTS

| | | |
|---|---|---|
| BE | 1006392 | 9/1994 |
| DE | 298 15 797 U1 | 10/1998 |
| EP | 0 161 779 | 11/1985 |
| EP | 0 221 631 | 5/1987 |
| EP | 0 245 555 | 11/1987 |

(Continued)

OTHER PUBLICATIONS

Unknown, "Radio Frequency Identification (RFID)—Standards, Common Applications, A Look Ahead, and Recommended Reading," http://www.aimglobal.org/techinfo/rfid/rfidintro.html, 4, Printed Jun. 7, 1999.

(Continued)

*Primary Examiner*—Troy Chambers
(74) *Attorney, Agent, or Firm*—McLane, Graf, Raulerson & Middleton, Professional Association

(57) ABSTRACT

A handgrip apparatus for firearm includes a hollow housing defining a handgrip surface and forming an enclosure. A fastener is connected to the housing for removably attaching the handgrip apparatus to a fore-end portion of a firearm. A retractable leg assembly is movable between a retracted position and an extended position and includes a pair of pivoting legs usable as a bipod support when the leg assembly is in the extended position. In one aspect, one or more switches for controlling operation of one or more electronic devices are coupled to the handgrip apparatus. One or more connectors are electrically coupled to the one or switches and are adapted to be electrically coupled to one or more electronic devices. In another aspect, a handgrip apparatus having a pivoting attachment between the fastener and the housing positions is provided. In another aspect, a handgrip apparatus includes integrated conductors in the fastener.

21 Claims, 25 Drawing Sheets

U.S. PATENT DOCUMENTS

| | | | | |
|---|---|---|---|---|
| 4,672,374 | A | | 6/1987 | Desjardins |
| 4,675,656 | A | | 6/1987 | Narcisse |
| 4,691,202 | A | | 9/1987 | Denne et al. |
| 4,774,570 | A | | 9/1988 | Araki |
| 4,777,526 | A | | 10/1988 | Saitoh et al. |
| 4,822,990 | A | | 4/1989 | Tamada et al. |
| 4,831,438 | A | | 5/1989 | Bellman, Jr. et al. |
| 4,833,807 | A | | 5/1989 | McLean |
| 4,862,160 | A | | 8/1989 | Ekchian et al. |
| 4,864,292 | A | | 9/1989 | Nieuwkoop |
| 4,951,147 | A | | 8/1990 | Aknar et al. |
| 4,955,038 | A | | 9/1990 | Lee et al. |
| 5,006,983 | A | | 4/1991 | Wayne et al. |
| 5,030,807 | A | | 7/1991 | Landt et al. |
| 5,051,741 | A | | 9/1991 | Wesby |
| 5,064,988 | A | * | 11/1991 | E'nama et al. ..... 219/121.6 |
| 5,086,480 | A | | 2/1992 | Sexton |
| 5,109,278 | A | | 4/1992 | Erickson et al. |
| 5,111,291 | A | | 5/1992 | Erickson et al. |
| 5,153,878 | A | | 10/1992 | Krebs |
| 5,175,729 | A | | 12/1992 | Borras et al. |
| 5,202,759 | A | | 4/1993 | Laylock |
| 5,206,639 | A | | 4/1993 | Kames |
| 5,220,557 | A | | 6/1993 | Kelley |
| 5,227,803 | A | | 7/1993 | O'Connor et al. |
| 5,229,850 | A | | 7/1993 | Toyoshima |
| 5,237,408 | A | | 8/1993 | Blum et al. |
| 5,266,925 | A | | 11/1993 | Vercellotti et al. |
| 5,272,476 | A | | 12/1993 | McArthur et al. |
| 5,287,269 | A | | 2/1994 | Dorrough et al. |
| 5,289,369 | A | | 2/1994 | Hirshberg |
| 5,305,008 | A | | 4/1994 | Turner |
| 5,321,396 | A | | 6/1994 | Lamming et al. |
| 5,351,052 | A | | 9/1994 | D'Hont et al. |
| 5,371,899 | A | | 12/1994 | Kuznicki et al. |
| 5,408,330 | A | | 4/1995 | Squicciarini et al. |
| 5,416,468 | A | | 5/1995 | Baumann |
| 5,423,574 | A | | 6/1995 | Forte-Pathroff |
| 5,425,032 | A | | 6/1995 | Shloss et al. |
| 5,432,864 | A | | 7/1995 | Lu et al. |
| 5,448,242 | A | | 9/1995 | Sharpe et al. |
| 5,450,087 | A | | 9/1995 | Hurta et al. |
| 5,450,492 | A | | 9/1995 | Hook et al. |
| 5,453,747 | A | | 9/1995 | D'Hont et al. |
| 5,455,575 | A | | 10/1995 | Schuermann |
| 5,471,212 | A | | 11/1995 | Sharpe et al. |
| 5,488,376 | A | | 1/1996 | Hurta et al. |
| 5,491,471 | A | | 2/1996 | Stobbe |
| 5,502,806 | A | | 3/1996 | Mahoney et al. |
| 5,519,381 | A | | 5/1996 | Marsh et al. |
| 5,523,737 | A | | 6/1996 | Luna |
| 5,525,992 | A | | 6/1996 | Froschermeier |
| 5,525,994 | A | | 6/1996 | Hurta et al. |
| 5,526,133 | A | | 6/1996 | Paff |
| 5,528,232 | A | | 6/1996 | Verma et al. |
| 5,539,394 | A | | 7/1996 | Cato et al. |
| 5,541,928 | A | | 7/1996 | Kobayashi et al. |
| 5,565,858 | A | | 10/1996 | Guthrie |
| 5,566,327 | A | | 10/1996 | Sehr |
| 5,576,838 | A | | 11/1996 | Renie |
| 5,581,297 | A | | 12/1996 | Koz et al. |
| 5,589,873 | A | | 12/1996 | Natori et al. |
| 5,621,412 | A | | 4/1997 | Sharpe et al. |
| 5,629,981 | A | | 5/1997 | Nerlikar |
| 5,633,875 | A | | 5/1997 | Hershey et al. |
| 5,640,151 | A | | 6/1997 | Reis |
| 5,668,803 | A | | 9/1997 | Tymes et al. |
| 5,684,828 | A | | 11/1997 | Bolan et al. |
| 5,686,902 | A | | 11/1997 | Reis et al. |
| 5,689,442 | A | | 11/1997 | Swanson et al. |
| 5,694,162 | A | | 12/1997 | Freeny, Jr. |
| 5,694,514 | A | | 12/1997 | Evans et al. |
| 5,721,733 | A | | 2/1998 | Wang et al. |
| 5,729,695 | A | | 3/1998 | Ahlm et al. |
| 5,737,330 | A | | 4/1998 | Fullthorp et al. |
| 5,742,237 | A | | 4/1998 | Bledsoe |
| 5,745,037 | A | | 4/1998 | Guthrie et al. |
| 5,748,908 | A | | 5/1998 | Yu |
| 5,754,541 | A | | 5/1998 | Glisic et al. |
| 5,774,459 | A | | 6/1998 | Charrat |
| 5,797,126 | A | | 8/1998 | Helbling et al. |
| 5,804,810 | A | | 9/1998 | Wolley et al. |
| 5,805,082 | A | | 9/1998 | Hassett |
| 5,808,587 | A | | 9/1998 | Shima |
| 5,811,772 | A | | 9/1998 | Lucero |
| 5,813,912 | A | | 9/1998 | Shultz |
| 5,818,915 | A | | 10/1998 | Hayes et al. |
| 5,822,714 | A | | 10/1998 | Cato |
| 5,837,982 | A | | 11/1998 | Fujioka |
| 5,839,058 | A | | 11/1998 | Phillips et al. |
| 5,841,365 | A | | 11/1998 | Rimkus |
| 5,842,131 | A | | 11/1998 | Yamane |
| D403,392 | S | | 12/1998 | Briggs et al. |
| 5,848,395 | A | | 12/1998 | Edgar et al. |
| 5,856,931 | A | | 1/1999 | McCasland |
| 5,857,152 | A | | 1/1999 | Everett |
| 5,866,890 | A | | 2/1999 | Neuner |
| 5,867,823 | A | | 2/1999 | Richardson |
| 5,870,029 | A | | 2/1999 | Otto et al. |
| 5,870,459 | A | | 2/1999 | Phillips et al. |
| 5,872,887 | A | | 2/1999 | Walker |
| 5,874,902 | A | | 2/1999 | Heinrich et al. |
| D406,871 | S | | 3/1999 | Briggs |
| D407,133 | S | | 3/1999 | Briggs |
| 5,880,453 | A | | 3/1999 | Wang et al. |
| 5,886,634 | A | | 3/1999 | Muhme |
| 5,892,454 | A | | 4/1999 | Schipper et al. |
| 5,894,589 | A | | 4/1999 | Reber et al. |
| 5,903,321 | A | | 5/1999 | Tung et al. |
| 5,918,211 | A | | 6/1999 | Sloane |
| 5,929,778 | A | | 7/1999 | Asama et al. |
| 5,932,869 | A | | 8/1999 | Gottlich et al. |
| 5,940,006 | A | | 8/1999 | MacLellan et al. |
| 5,942,987 | A | | 8/1999 | Heinrich et al. |
| 5,946,444 | A | | 8/1999 | Evans et al. |
| 5,946,613 | A | | 8/1999 | Hayes, Jr. et al. |
| 5,956,259 | A | | 9/1999 | Hartsell, Jr. et al. |
| 5,959,277 | A | | 9/1999 | Lucero |
| 5,966,068 | A | | 10/1999 | Wicks et al. |
| 5,966,654 | A | | 10/1999 | Croughwell et al. |
| 5,973,613 | A | | 10/1999 | Reis et al. |
| 5,978,770 | A | | 11/1999 | Waytena et al. |
| 5,978,821 | A | | 11/1999 | Freeny |
| 5,987,421 | A | | 11/1999 | Chuang |
| 6,003,013 | A | | 12/1999 | Boushy et al. |
| 6,028,626 | A | | 2/2000 | Aviv |
| 6,034,603 | A | | 3/2000 | Steeves |
| 6,061,344 | A | | 5/2000 | Wood, Jr. |
| 6,127,928 | A | | 10/2000 | Issacman et al. |
| 6,130,623 | A | | 10/2000 | MacLellan et al. |
| 6,232,877 | B1 | | 5/2001 | Ashwin |
| 6,271,752 | B1 | | 8/2001 | Vaios |
| 6,275,476 | B1 | | 8/2001 | Wood, Jr. |
| 6,294,953 | B1 | | 9/2001 | Steeves |
| 6,385,772 | B1 | | 5/2002 | Courtney |
| 6,433,683 | B1 | | 8/2002 | Robinson |
| 6,456,321 | B1 | | 9/2002 | Ito et al. |
| 6,460,069 | B1 | | 10/2002 | Berlin et al. |
| 6,462,660 | B1 | | 10/2002 | Cannon et al. |
| 6,487,807 | B1 | * | 12/2002 | Kopman et al. ..... 42/94 |
| 6,568,118 | B1 | * | 5/2003 | Teetzel ..... 42/105 |
| 6,570,487 | B1 | | 5/2003 | Steeves |
| 6,570,498 | B1 | | 5/2003 | Frost et al. |
| 6,686,829 | B1 | | 2/2004 | Hohberger et al. |

| | | | | |
|---|---|---|---|---|
| 6,785,997 | B2 * | 9/2004 | Oz | 42/94 |
| 6,931,775 | B2 * | 8/2005 | Burnett | 42/72 |
| 7,005,985 | B1 | 2/2006 | Steeves | |
| 7,111,424 | B1 | 9/2006 | Moody et al. | |
| 7,243,454 | B1 * | 7/2007 | Cahill | 42/72 |
| 7,271,727 | B2 | 9/2007 | Steeves | |
| 7,286,158 | B1 | 10/2007 | Griebenow | |
| 7,421,817 | B2 * | 9/2008 | Larsson | 42/127 |
| 7,438,430 | B2 * | 10/2008 | Kim | 362/110 |
| 7,568,304 | B1 * | 8/2009 | Moody et al. | 42/72 |
| 2003/0226305 | A1 * | 12/2003 | Burnett | 42/90 |
| 2005/0241206 | A1 * | 11/2005 | Teetzel et al. | 42/72 |
| 2006/0066444 | A1 | 3/2006 | Steeves | |
| 2006/0071756 | A1 | 4/2006 | Steeves | |
| 2006/0140374 | A1 | 6/2006 | Light et al. | |
| 2006/0191183 | A1 * | 8/2006 | Griffin | 42/72 |
| 2007/0159338 | A1 | 7/2007 | Beber | |
| 2007/0205896 | A1 | 9/2007 | Beber | |
| 2007/0285241 | A1 | 12/2007 | Griebenow | |
| 2008/0042850 | A1 | 2/2008 | DeWitte | |

FOREIGN PATENT DOCUMENTS

| | | |
|---|---|---|
| EP | 0 467 036 | 1/1992 |
| EP | 0 565 046 | 10/1993 |
| EP | 0 781 049 | 6/1997 |
| GB | 2 187 317 | 9/1987 |
| GB | 2 250 156 | 5/1992 |
| GB | 2 295 065 | 5/1996 |
| GB | 2 307 324 | 5/1997 |
| WO | WO 88/04082 | 6/1988 |
| WO | WO 90/01838 | 2/1990 |
| WO | WO 91/17515 | 11/1991 |
| WO | WO 93/04537 | 3/1993 |
| WO | WO 95/12858 | 5/1995 |
| WO | WO 95/22138 | 8/1995 |
| WO | WO 96/03839 | 2/1996 |
| WO | WO 96/27864 | 12/1996 |
| WO | WO 98/10358 | 3/1998 |
| WO | WO 98/11520 | 3/1998 |

OTHER PUBLICATIONS

AIM International, Inc., "Radio Frequency Identification RFID—A Glossary: AIM International WP-98/001R," http://www.aimglobal.org/techinfo/rfid/aimrfidglossary, Printed Jun. 7, 1999.

AIM International, Inc., "Radio Frequency Identification RFID—A Basic Primer: AIM International WP-98/002R," http://www.aimglobal.org/techinfo/rfid/aimrfidbasics.htm, Printed Jun. 7, 1999.

International Search Report, Application No. PCT/US01/14467, 7 pages, Mailed Sep. 13, 2001.

International Search Report, Application No. PCT/US00/42802, 12 pages, Mailed Apr. 8, 2002.

International Search Report, Application No. PCT/US00/05772, 8 pages, Mailed Jul. 14, 2000.

International Search Report, Application No. PCT/US00/33569, 6 pages, Mailed Apr. 5, 2001.

Boehringer, "Integrated Security System and Method," U.S. Appl. No. 09/569,523, filed May 12, 2000.

Steeves, "Method and System for Networking Radio Tags in a Radio Frequency Identification System," U.S. Appl. No. 11/270,696, filed Nov. 9, 2005.

Beber et al., "System and Method for Determining Location, Directionality, and Velocity of RFID Tags," U.S. Appl. No. 11/681,560, filed Mar. 2, 2007.

Griebenow et al., "Multi-Tag Tracking Systems and Methods," U.S. Appl. No. 11/688,681, filed Mar. 20, 2007.

De Witte et al., "Radio Frequency Identification (RFID) Tag Antenna Design," U.S. Appl. No. 11/747,700, filed May 11, 2007.

* cited by examiner

HAND GRIP APPARATUS FOR FIREARM

CROSS-REFERENCE TO RELATED APPLICATION

This application claims priority, as a continuation-in-part type application, under 35 U.S.C. §120 to U.S. patent application Ser. No. 11/084,942 filed Mar. 21, 2005, now pending, which properly claimed priority under 35 U.S.C. §119(e) to U.S. provisional application Ser. No. 60/555,279 filed Mar. 22, 2004. Each of the aforementioned applications is incorporated by reference in its entirety.

BACKGROUND

The present disclosure relates to a combination handgrip and bipod for firearm, as well as a method of supporting a firearm using same. The device in accordance with the present disclosure is convertible between a handgrip and a bi-pod or rest, and finds wide utility for use in connection with firearms, including without limitation, military and police use and training, hunting, target shooting, and the like.

SUMMARY

A handgrip apparatus for firearm includes a hollow housing defining a handgrip surface and forming an enclosure. A fastener is connected to the housing for removably attaching the handgrip apparatus to a fore-end portion of a firearm. A retractable leg assembly is movable between a retracted position and an extended position and includes a pair of pivoting legs usable as a bipod support when the leg assembly is in the extended position.

In one aspect of the present disclosure, one or more switches for controlling operation of one or more electronic devices are coupled to the handgrip apparatus and one or more connectors are electrically coupled to the one or switches and are adapted to be electrically coupled to one or more electronic devices.

In another aspect of the present disclosure, a handgrip apparatus having a pivoting attachment between the fastener and the housing positions is provided.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
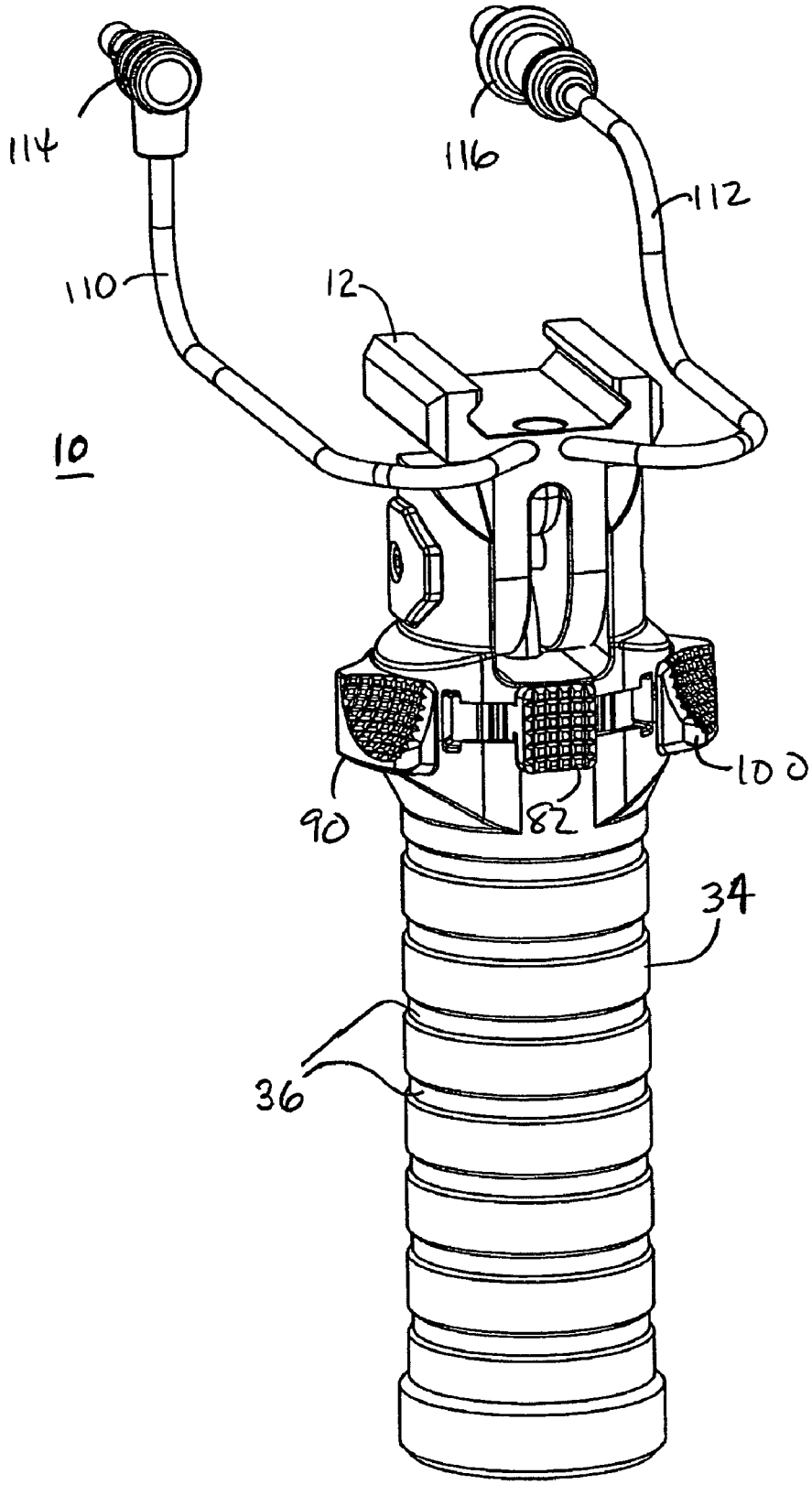
FIG. 1 is a perspective view of a removable handgrip according to a first exemplary embodiment of the present invention.
Figure 2:
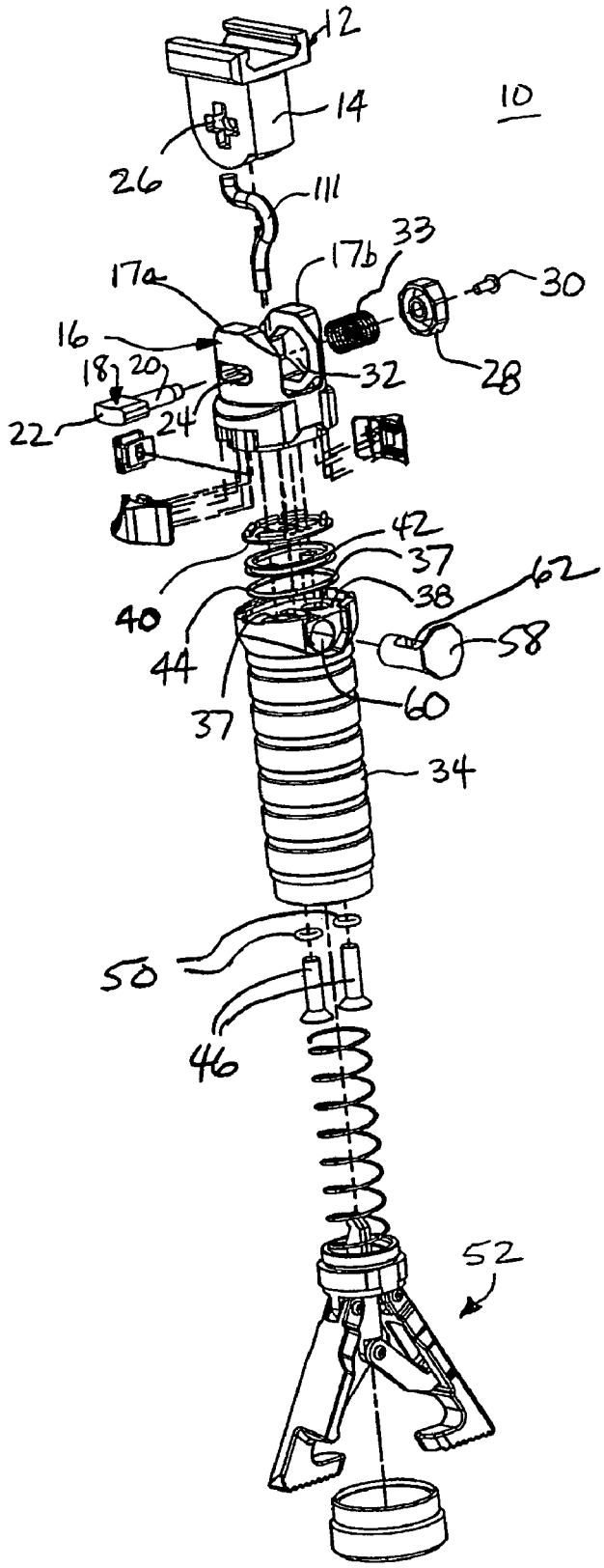
FIG. 2 is an exploded view of the handgrip embodiment shown in FIG. 1.
Figure 3:
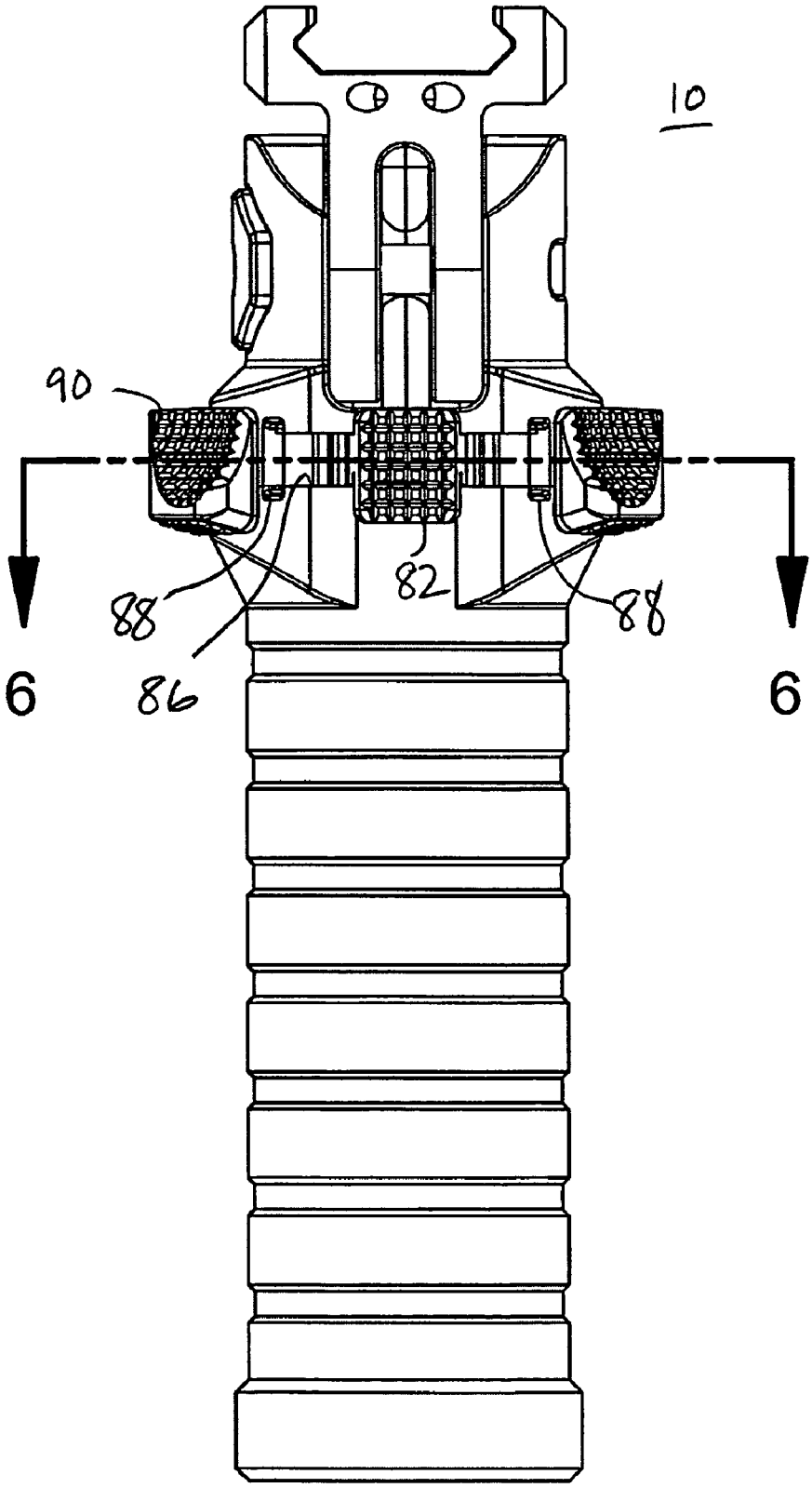
FIG. 3 is a front elevational view of the handgrip embodiment appearing in FIG. 1, with the bipod assembly shown in the stored position.
Figure 4:
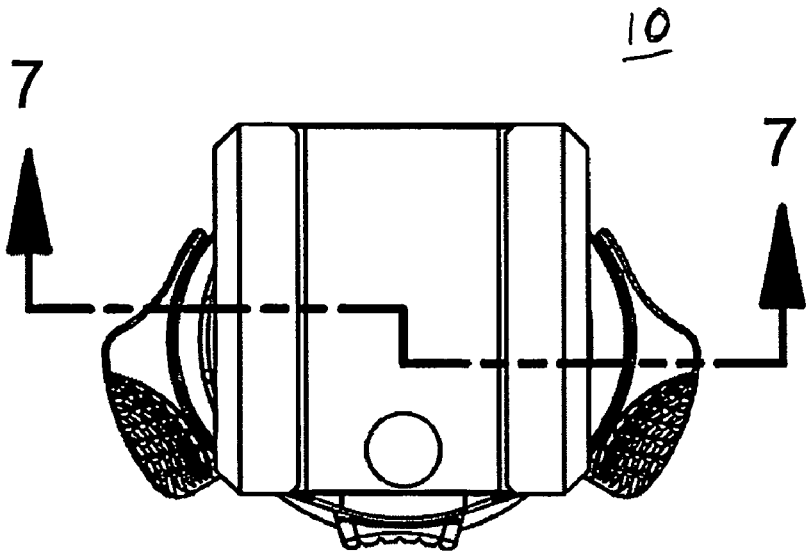
FIG. 4 is a top plan view of the embodiment shown in FIG. 1, with the bipod leg assembly in the stored position.
Figure 5:
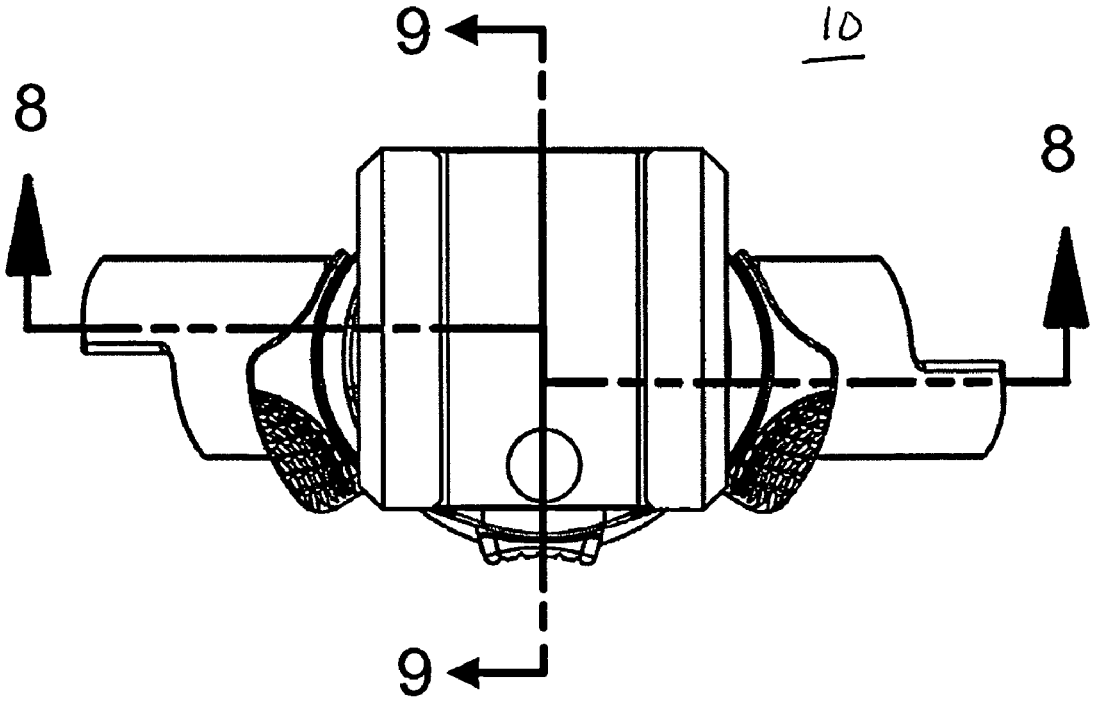
FIG. 5 is a top plan view of the embodiment shown in FIG. 1, with the bipod leg assembly in the extended position.

In the course of describing the hand grip embodiments herein, the is bottom of the device will refer to the lower end of the unit when the hand grip is in the generally vertical, operative position and the upper or top will refer to the opposite end, that is, the end that is proximate the firearm when the hand grip is attached to a firearm and in the generally vertical, operative position.

Referring to drawing figures, in which like reference numerals refer to like or analogous components throughout the several views, FIGS. 1-10 depict a hand grip apparatus 10 includes a weapon mount or interface member 12 adapted to be removably mounted to the forearm portion of a firearm (not shown). In the illustrated embodiment, the preferred mounting member 12 depicted is adapted to be attached to a Picatinny rail interface (e.g., as specified in MIL-STD-1913).

The weapon mount 12 is shown somewhat generally and may be one of many variations of means for attachment to the MIL-STD-1913 accessory rail, including clamp, drawbar, thumbnut, and throw lever configurations, and the like. The weapon mount 12 may alternatively custom barrel or stanchion mounting portion. It will be recognized that the handgrip apparatus herein may be adapted for use with all manner firearms, including without limitation rifles, handguns, machine guns, mortars, etc., and all manner of weapon accessory mount rail interfaces or mounting systems. In a preferred embodiment, the weapon mount may be as described in the aforementioned Ser. No. 11/084,942. Alternatively, the weapon mount may employ a three-point clamp mechanism as described in U.S. provisional application Ser. No. 60/855,928 filed on Nov. 1, 2006, and incorporated herein by reference in its entirety.

The mounting member 12 includes a pivot tongue 14 pivotally received within a pivot yoke 16 having a pair of opposing struts 17*a* and 17*b*. A pivot lock and release assembly is provided to allow the hand grip 10 to pivot between a generally vertical or downwardly extending operative position and a folded position in which the hand grip extends in a direction generally parallel to the forearm portion of the firearm to which it is attached. In a preferred embodiment, when the handgrip is in the downward position, it is angled toward the user to minimize bending of the users wrist, preferably about 3-12 degrees is with respect to the barrel, and more preferably about 5 degrees. Thus, as used herein, such terms indicating orientation, such as "vertical," "generally vertical," "horizontal," "generally horizontal," and so forth, are intended to include such variations.

The pivot lock and release assembly includes a pivot locking member 18 including shaft portion 20 and an enlarged head portion 22. The shaft portion 20 is received through an opening 24 in the strut 17*a* and an opening 26 in the pivot tongue 14 and defines a pivot axis about which the mounting member 12 rotates relative to the pivot yoke 16. A pivot lock release button 28 is secured to the shaft 20 via a fastener 30 (e.g., a threaded fastener) and is received within opening 32 in the yoke 17*b*. The release button 28 is urged to the locked position via a compression spring 33, which may be for example a conical or cylindrical coil spring, or the like, and which is captured between the pivot lock release 28 and the tongue 14.

The opening 26 is generally "+" shaped and can selectively engage the enlarged portion 22 of the pivot lock 18 in both the downward position and the folded position. In operation, pressing the button 28 against the urging of the spring 33 moves the enlarged portion 22 out of engagement with the opening 26, thereby allowing the yoke 16 to pivot freely relative to the mounting member 12.

In addition to converting between the vertical and folded positions via the pivot yoke 16, the handgrip 10 also converts between a handgrip mode of operation and a bi-pod mode of operation. In the handgrip mode of operation, the handgrip 10 may used as a conventional, generally vertical hand grip, for example, in the case of a military rifle, wherein (for a right-handed marksman) the handgrip 10 is grasped by the left hand and a pistol grip of the firearm is grasped by the right hand, with the butt stock held against the right shoulder.

In the bi-pod mode of operation, the handgrip device 10 functions as a gun rest to support the front of the weapon above a support surface during targeting or shooting operations. While the bi-pod legs of the depicted embodiment may advantageously be employed to support the fore end of a firearm on the ground by a user in a prone position, it will be recognized that the is support legs may be used to support a firearm on any generally horizontal surface on which it may be desired to support a firearm, such as a tabletop, bench, floor, the ground, pavement, a vehicle surface, or the like.

The handgrip 10 additionally includes a handgrip housing 34. The housing 34 may be made of any rigid material, and in a preferred embodiment is made from aluminum, more preferably lightweight aircraft aluminum. The handgrip housing 34 may include handgrip features 36 on its external surface, such as circumferential grooves, ridges, knurls, or other handgrip features on its external surface. In addition, the housing 34 may be textured, e.g., via sandblasting, to improve grip. Optionally, finger recesses and/or a soft or resilient material (not shown) to improve the user's grasp may be provided on the exterior surface of the housing 34.

The handgrip housing 34 may be generally tubular and is open at the bottom end. The housing is substantially closed at or near the upper end and defines a cavity 38 at the upper end for receiving a circuit board 40, such as a printed circuit board having conductive tracings, e.g., a printed circuit relief pattern, carrying one or more switches as discussed in greater detail below. The circuit board is received in a sealing plate 42 having a sealing gland or ring 44 received about the periphery of the sealing plate 42 to prevent ingress of moisture or other contaminants from entering the cavity 38.

Threaded fasteners 46 pass through aligned openings 37 in the base of the cavity 38 and corresponding aligned openings in the sealing plate 42 and the circuit board 40 and rotatably engage aligned threaded openings 48 in the yoke 16 to secure the handgrip housing 34 thereto. Sealing rings 50 may be provided to prevent ingress of moisture via the openings 37.

A collapsible leg assembly 52 includes first and second legs 54 pivotally attached to a piston member 56 slidably received within the interior of the housing 34. A release button 58 slidably extends through an opening 60 in the housing 34. The release button 58 includes an opening 62 and has a latch member 64 interiorly formed therein. As can best be seen in FIG. 7, which shows the leg assembly 52 retracted within the housing 34, the leg assembly 52 is includes a hook member 66 releasably engaging the internal latch member 64.

A spring flange or cup 67 is attached to or formed with the hook member 66 and receives a first end of a spring 68, such as a conical or cylindrical (in the embodiment shown) coil spring. The second end of the spring 68 bears against the interior surface of the upper end of the housing 34. In operation, when the release button 58 is depressed (e.g., against the urging of a captured spring (not shown), the latching member 64 is moved out of engagement with the hook 66. The spring 68 then forces the spring flange 67 and the piston 56 downward toward the open end of the housing 34.

Figure 8:
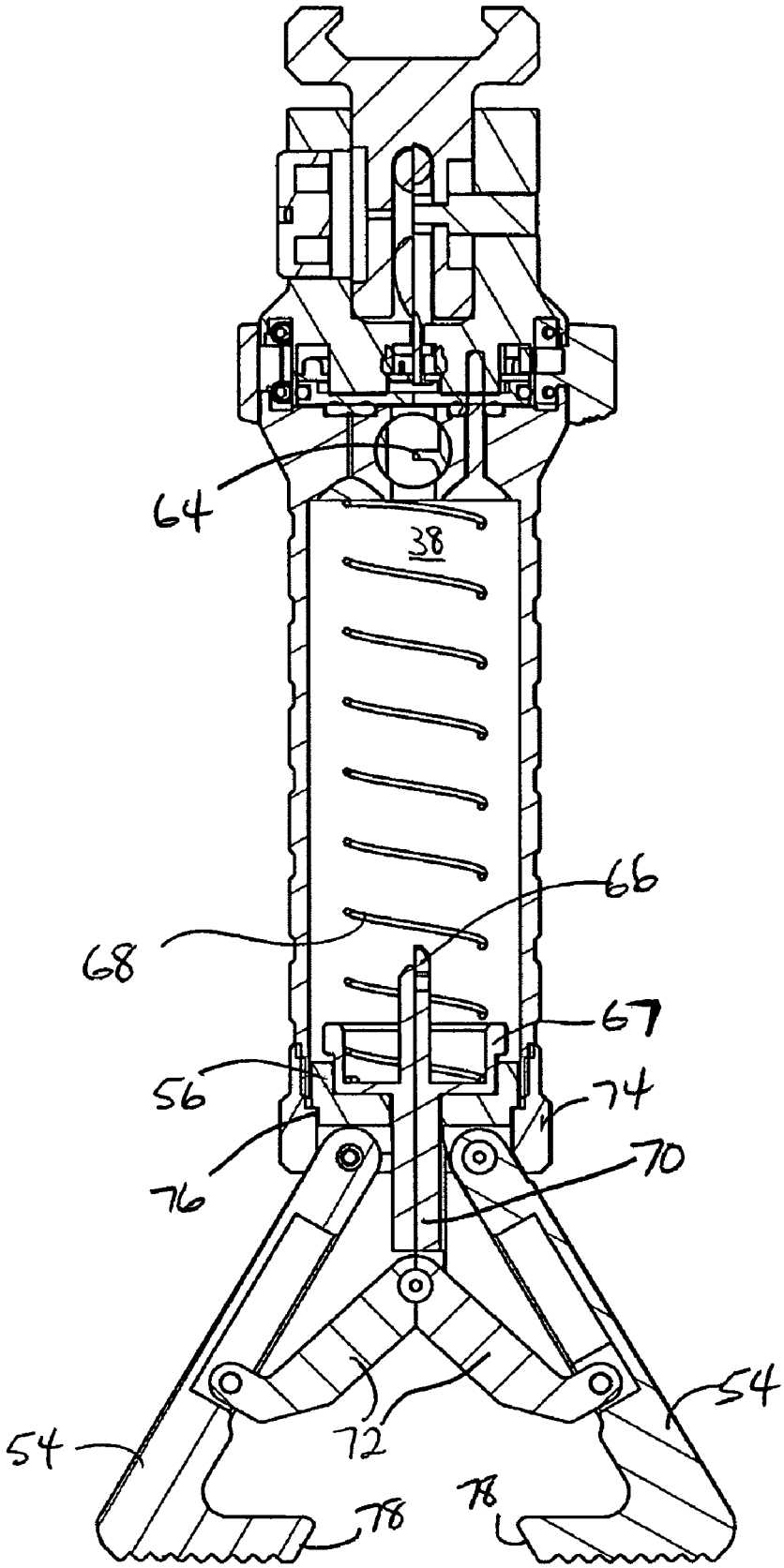
FIG. 8 is a cross-sectional, elevational view taken along the lines 8-8 in FIG. 5.
Figure 9:
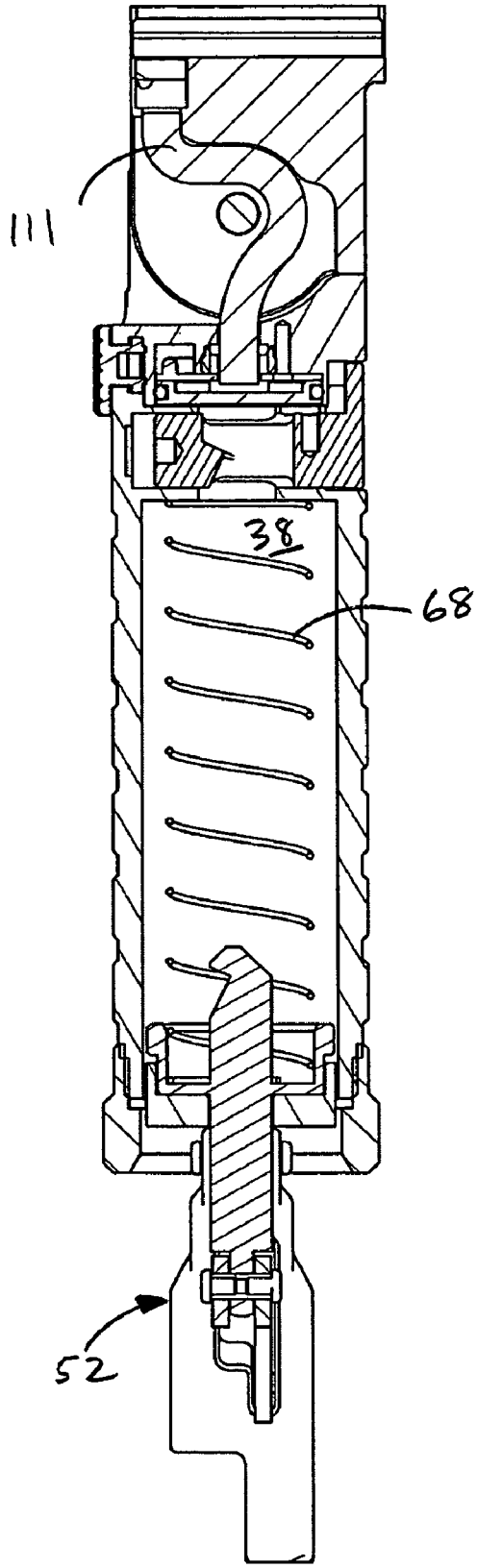
FIG. 9 is a cross-sectional, elevational view taken along the lines 9-9 in FIG. 5.

An axial member 70 extends downwardly from the spring flange 67, which may be integrally or separately formed with the spring flange 67 and/or hook member 66. Two leg spreader arms 72 are pivotally attached at one end to the lower end of the axial member 70 and at the opposite end to one of the legs 54. Downward movement of the axial member 70 relative to the piston 56 causes the spreader arms 72 to spread the bipod legs 54, as shown in FIG. 8.

Figure 11:
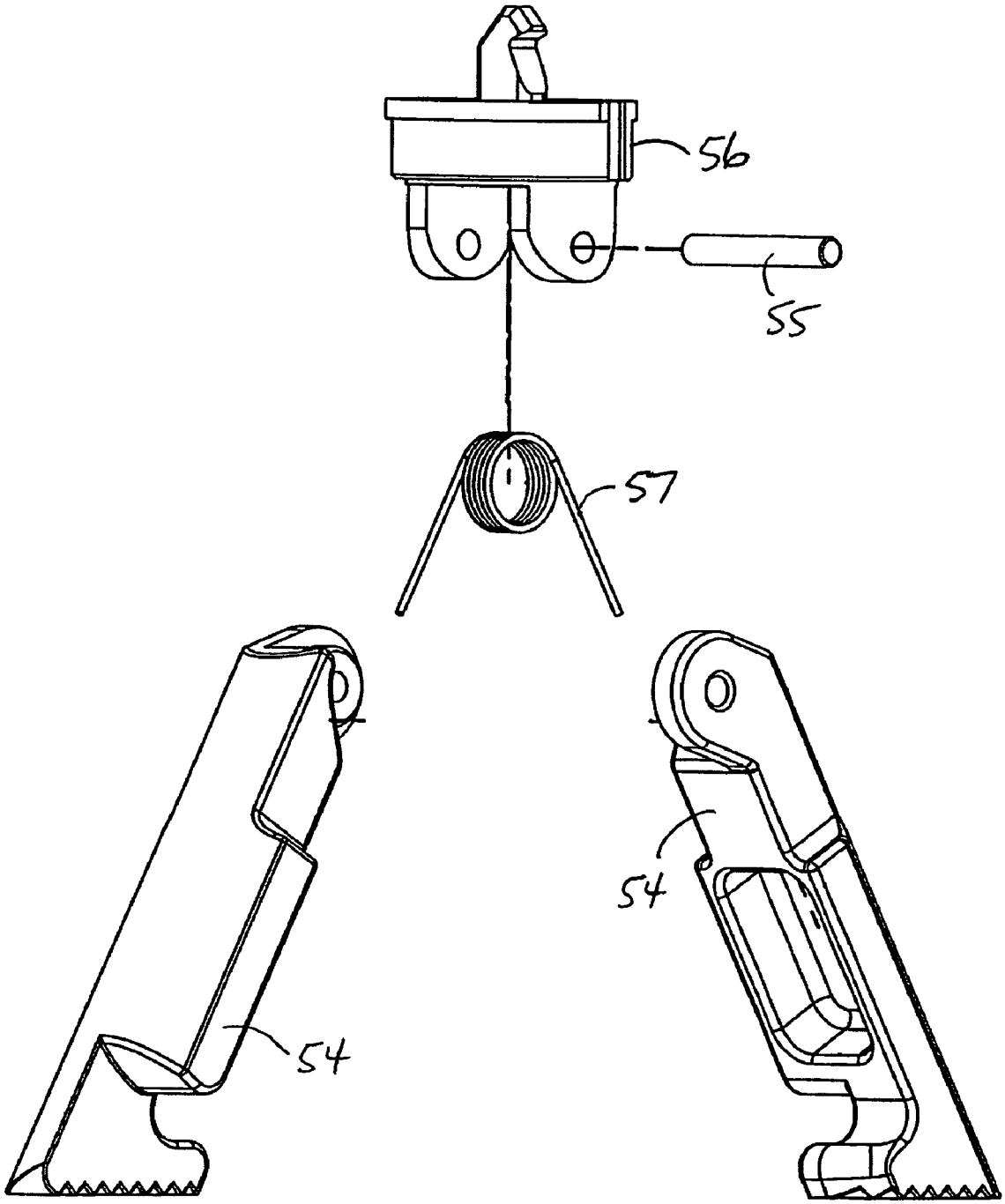
FIG. 11 is an exploded view an alternative leg assembly which may be employed with the handgrip embodiments herein.

In an alternative embodiment, as illustrated in FIG. 11, the bipod legs 54 are pivotally attached to the piston 56 via a pivot pin 55. A torsion spring 57 or the like is positioned between the legs 54 to move the legs to the outward position when, during operation, the legs are moved out of the housing 34.

An end cap or base ring 74 is attached to the lower end of the housing 34, for example via internal threads rotatably engaging external threads formed on the housing 34. The end cap includes an inwardly extending lip or shoulder 76 which engages the piston 56 and stops the downward motion thereof when the leg assembly 52 is extended. Alternatively, the end cap 74 may be secured to the housing via a number of fastener types, such as set screws, adhesives, clips, dogs, pawls, or the like, or combinations thereof.

To retract the bipod legs 54, the legs are simply collapsed and reinserted into the housing 34, against the bias of the spring 68, wherein the hook 66 engages the latch member 64. The legs 54 in the depicted embodiment include inverted feet 78, which allow the legs 54 and feet 78 to be completely received within the housing 34. Alternatively, pivoting feet may be attached to the legs, for example, as described in the aforementioned Ser. No. 11/084,942. The lower surface of the feet 78 may be grooved or otherwise textured to prevent slippage on the support surface.

Figure 10:
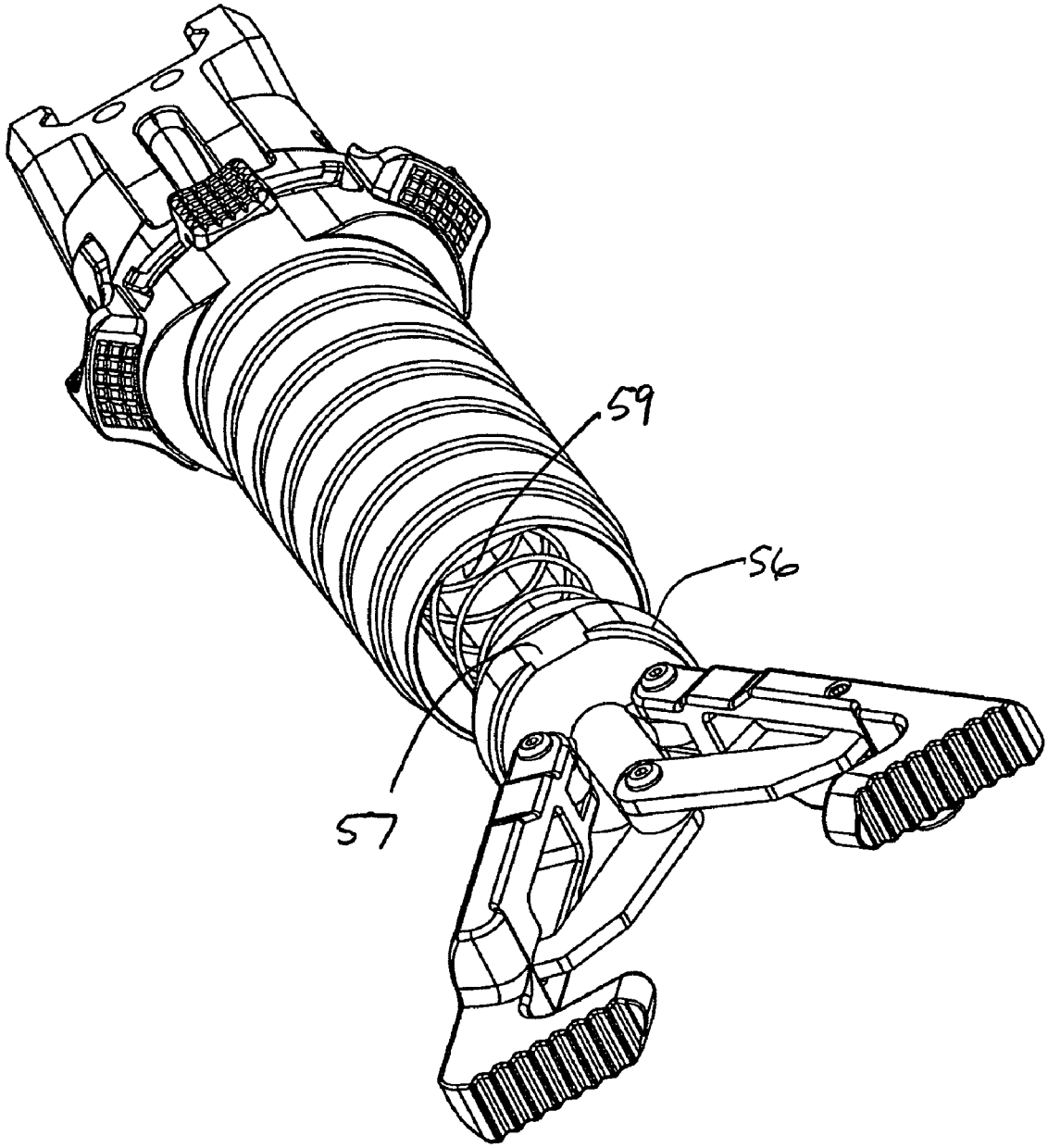
FIG. 10 is a partially exploded perspective view illustrating a preferred means for limiting rotation of the bipod leg assembly relative to the handgrip housing.

In the preferred embodiment, the piston 56 and the interior axial wall of the housing 34 are not perfectly or completely round, but instead are shaped or keyed to prevent rotation of the leg assembly 52 relative to the housing 34, or, more preferably, to limit the degree of relative rotation between the leg assembly 52 and the housing 34 to some specified amount. In the depicted embodiment, as best seen in FIG. 10, the piston 56 includes a flattened surface 57 at its periphery that corresponds to a like flattened surface 59 on the interior wall of the housing 34. A similar keyed arrangement may be accomplished by a number of other methods, such as providing one or more protrusions on the piston 56 which slidingly mate with one or more corresponding aligned grooves or channels formed in the inner wall of the housing 34. Alternatively, or additionally, one or more elongate projections on the inner wall of the housing 34 may slidingly engages one or more corresponding complimentary grooves in the piston 56 periphery. Likewise, any other mating, non-circular geometric configuration of the piston 56 and the housing 34 interior cross-sectional shape may be employed.

By close tolerencing of the dimensions of the housing 34 interior shape and the peripheral shape of the piston 56, rotation of the leg assembly 52 relative to the housing 34 and thus, relative to the firearm, can be avoided, thereby ensuring that, when deployed, the legs will be in the proper orientation with respect to the firearm. That is, the legs will be spaced apart transversely with respect to the firearm axial direction. More preferably, however, the piston 56 peripheral shape is made slightly smaller or loose with respect to the housing interior shape, thereby allowing some play between the leg assembly 52 and the housing 34. In this manner, some degree of rotation is permitted between the leg assembly 52 and the housing 34. By selecting the dimensions of the piston with respect to the housing interior dimensions, any desired degree of rotation may be provided. Such relative rotation is advantageous in that it permits the weapon to be horizontally pivoted for aiming or targeting purposes without the need to move or shift the feet relative to the underlying support surface.

Alternatively, a circular piston 56 and housing interior shape may be provided and the relative rotation therebetween may be limited to a desired range via the placement of internal stop members, e.g., as described in the aforementioned Ser. No. 11/084,942.

The depicted preferred handgrip embodiment 10 includes integrated switches which may be used to actuate or control one or more electronic devices, such as one or more electronic devices or accessories mounted on the weapon. However, in alternative embodiments, the integrated switches may be omitted. In still other embodiments, such switches may be exteriorly mounted on the handgrip housing 34, for example, as shown and described in the aforementioned Ser. No. 11/084,942.

Figure 6:
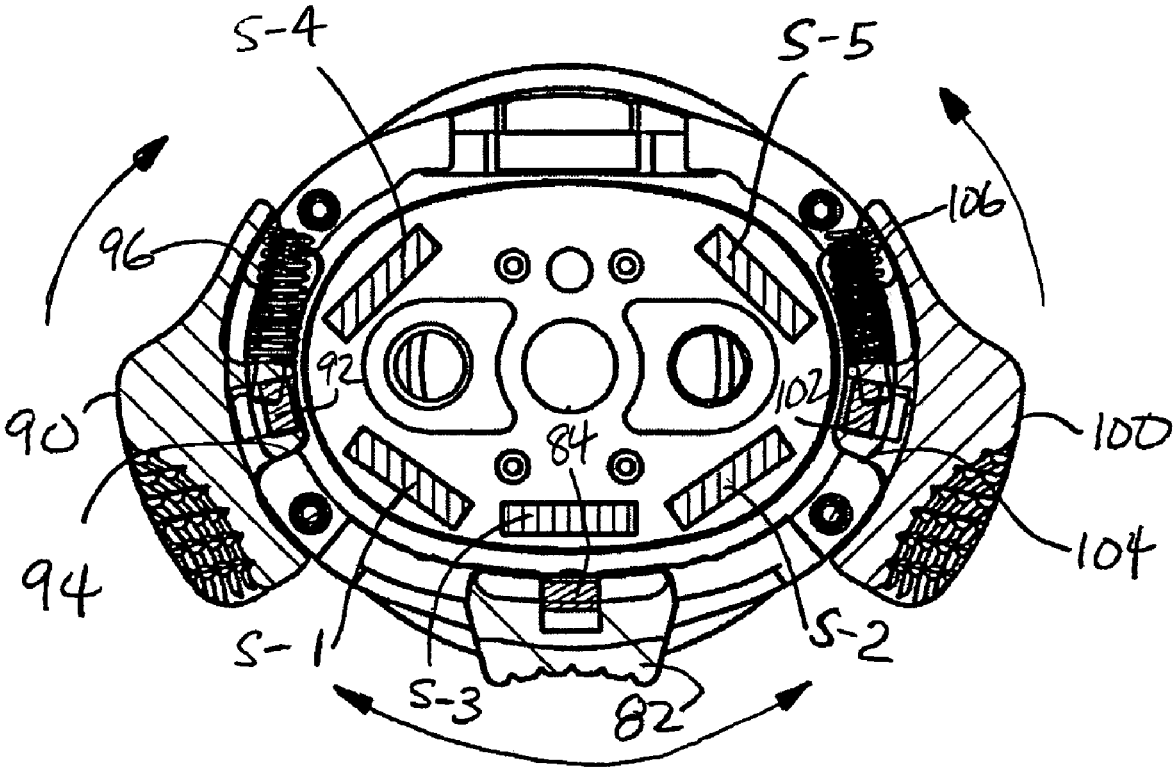
FIG. 6 is a plan cross-sectional view taken along the lines 6-6 in FIG. 3.
Figure 7:
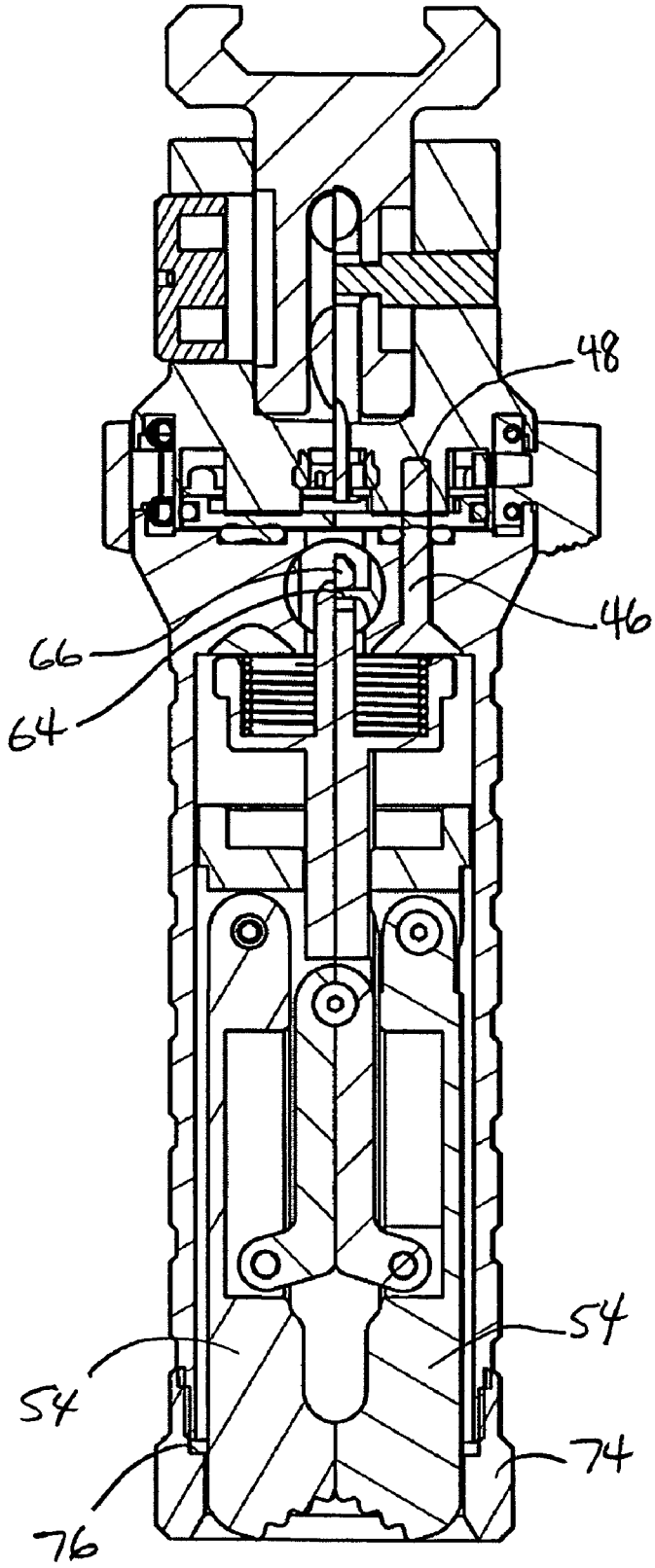
FIG. 7 is a cross-sectional, elevational view taken along the lines 7-7 in FIG. 4.

The circuit board 40 includes a plurality of switches mounted thereon for the selective actuation or control of one or more electronic accessories. As best seen in FIG. 6, in the depicted embodiment, the circuit board 40 includes switches S-1-S-5. The switches S-1-S-5 are preferably magnetically actuated switch devices, most preferably magnetic reed switches, although other magnetic switch devices such as relays, Hall effect devices, etc. are also contemplated. Of course, other types of switches, such as a mechanical contact switches, e.g., as toggle, sliding contact, rocker actuator, push button switches, may be employed as well, but are less desirable because they pose additional sealing requirements to prevent entry of moisture or environmental contaminants. In still other embodiments, logic controlled switches may be employed.

A device selector 82 is slidable to selectively open or close the switches S-1, S-2, and S-3. In the depicted embodiment employing magnetic reed switches, the selector 82 carries a magnet 84. The magnetic reed switches are of the normally open type and close when the magnet 84 is moved into alignment therewith. The device selector 82 slidably moves in a slot 86. Notches 88 or like features are provided in the slot 86 to retain the selector 82 at a desired position.

When the selector 82 carrying the magnet 84 is moved from alignment with the switch S-3 and into alignment with the switch S-1, the switch S-1 is closed. Likewise, when the selector 82 is moved from alignment with the switch S-3 and into alignment with the switch S-2, the switch S-2 is closed.

A left device actuator 90 carrying a magnet 92 is slidably movable in a slot 94. One or more compression springs 96, e.g., conical or cylindrical coil springs, normally bias the actuator 90 so that the magnet 92 is moved out of alignment with the switch S-4 causing the switch S-4 to be open. When the actuator 90 is moved against the bias of the spring(s) 96 so that the magnet 92 is aligned with the switch S-4, the switch S-4 closes.

A right device actuator 100 carrying a magnet 102 is slidably movable in a slot 104. One or more compression springs 106 normally bias the actuator 100 so that the magnet 102 is moved out of alignment with the switch S-5 causing the switch S-5 to be open. When the actuator 100 is moved against the bias of the spring(s) 106 so that the magnet 102 is aligned with the switch S-5, the switch S-5 closes.

The bias of the springs 96, 106 allows each of the actuators 90 and 100 to be operated as momentary switches. A notch or detent in the slots 94, 104 may be provided to allow the actuators to catch in the on position. The actuators may be released by moving the actuators 90, 100 out of the respective notch or detent.

Figure 12:
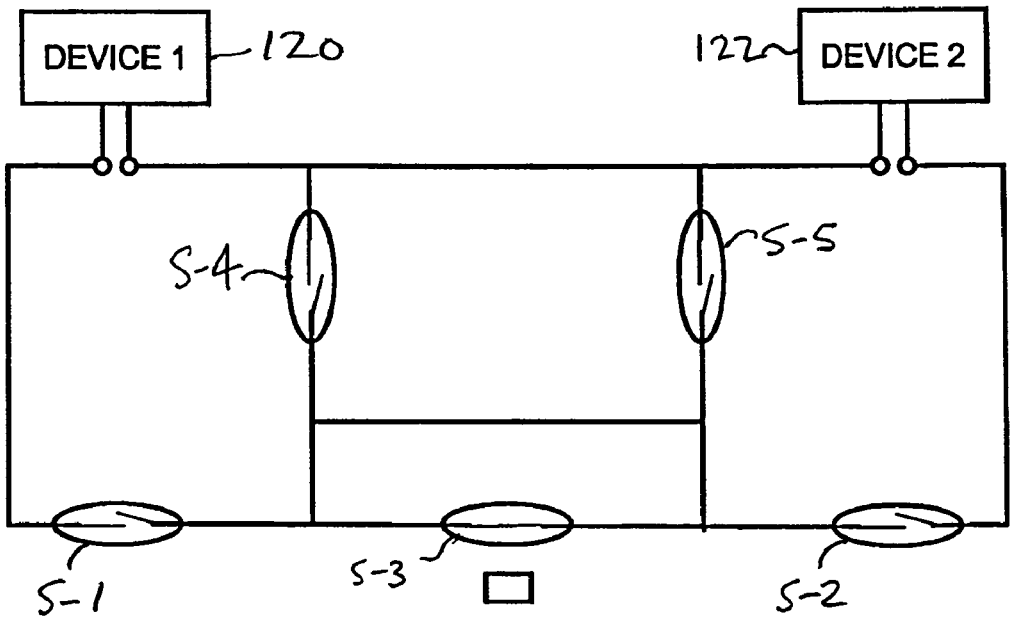
FIG. 12 is a schematic diagram of a first exemplary embodiment switch configuration.
Figure 13:
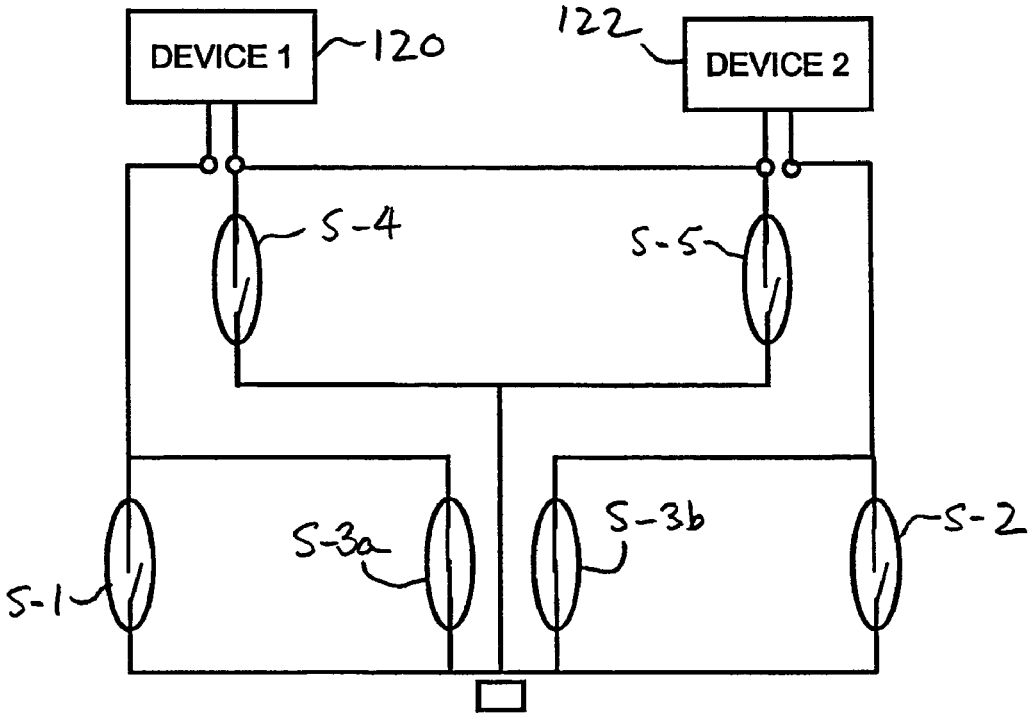
FIG. 13 is a schematic diagram of a second exemplary embodiment switch configuration.
Figure 14:
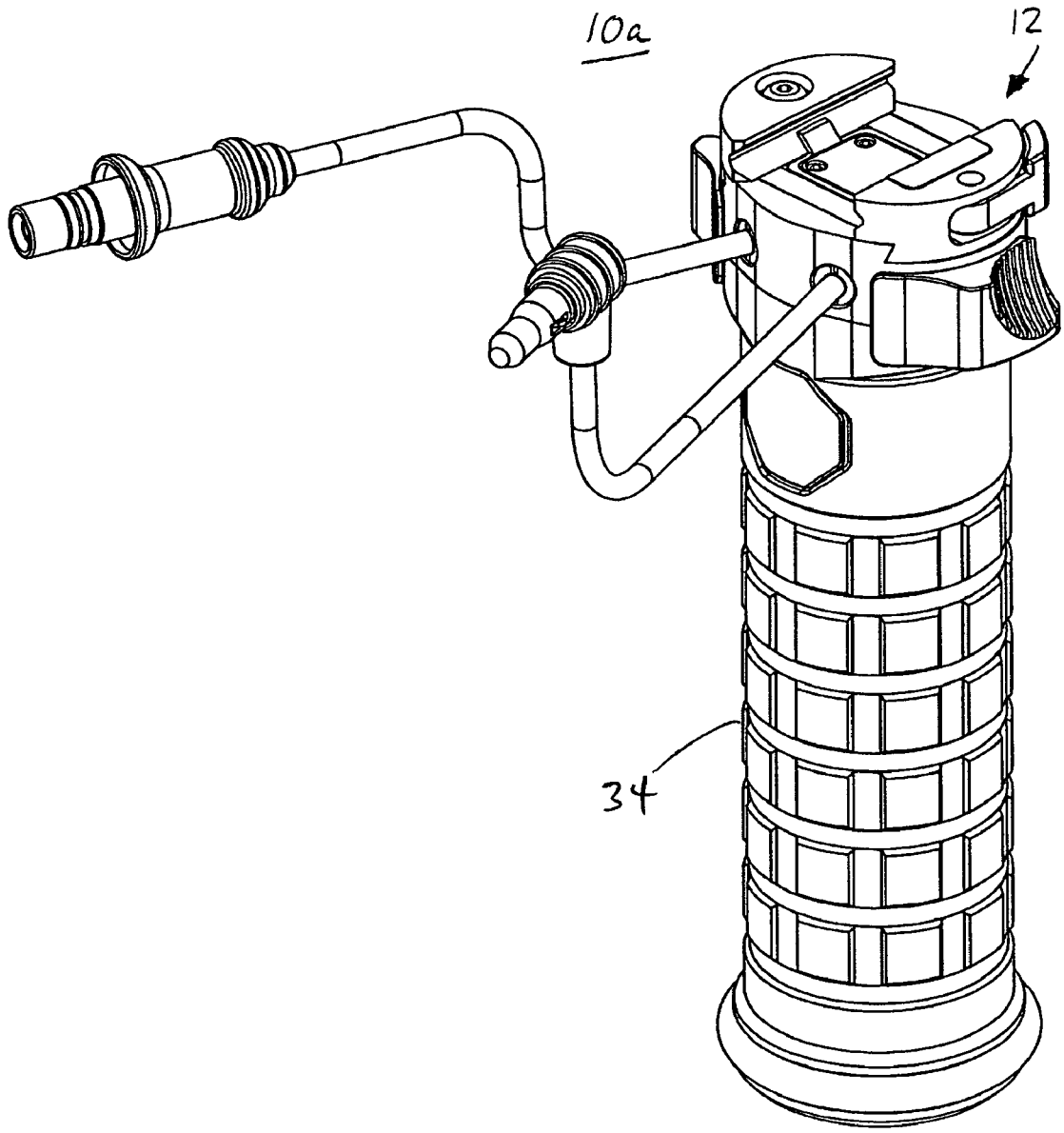
FIG. 14 is a perspective view of a removable handgrip is according to a second exemplary embodiment of the present invention.
Figure 15:
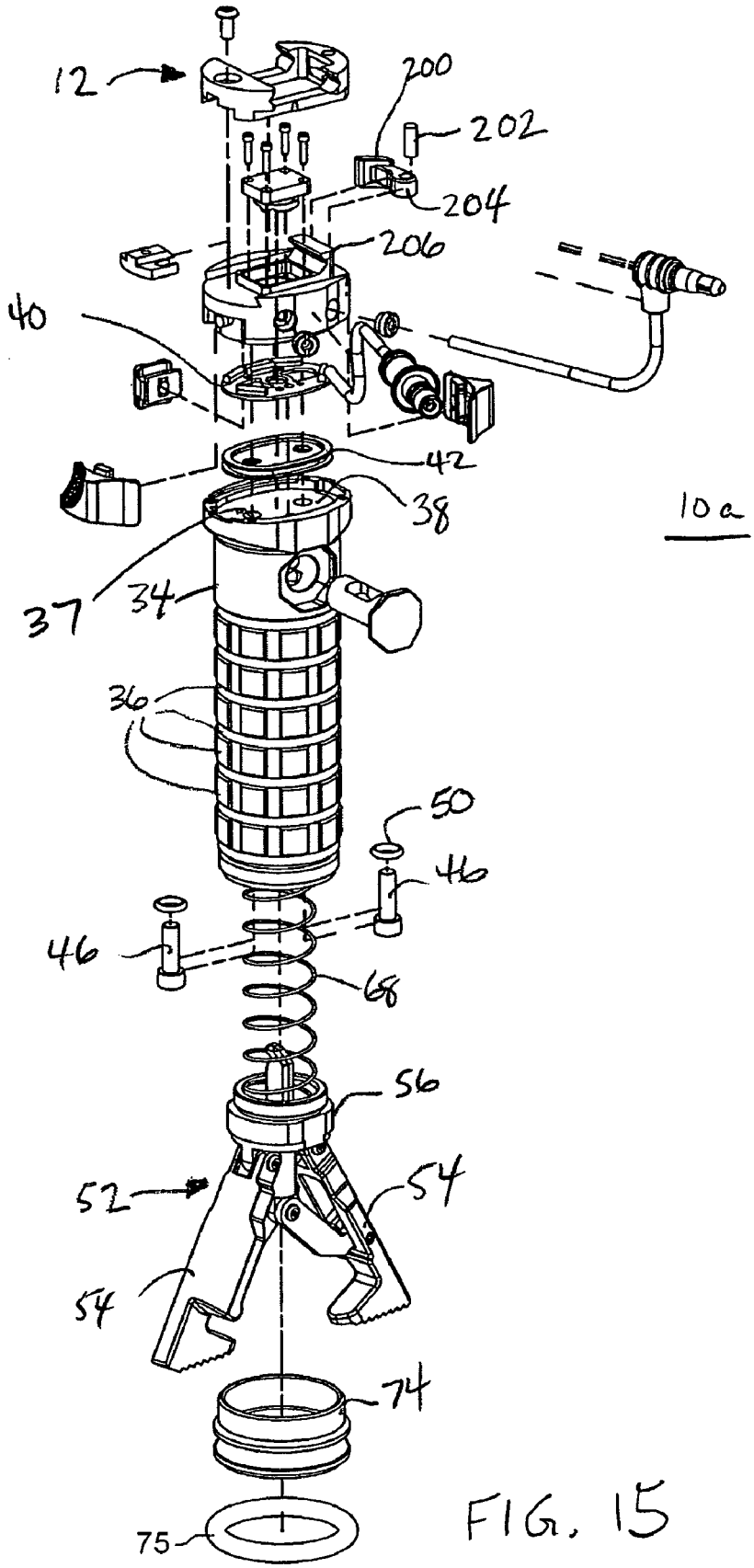
FIG. 15 is an exploded view of the handgrip embodiment shown in FIG. 14.
Figure 16:
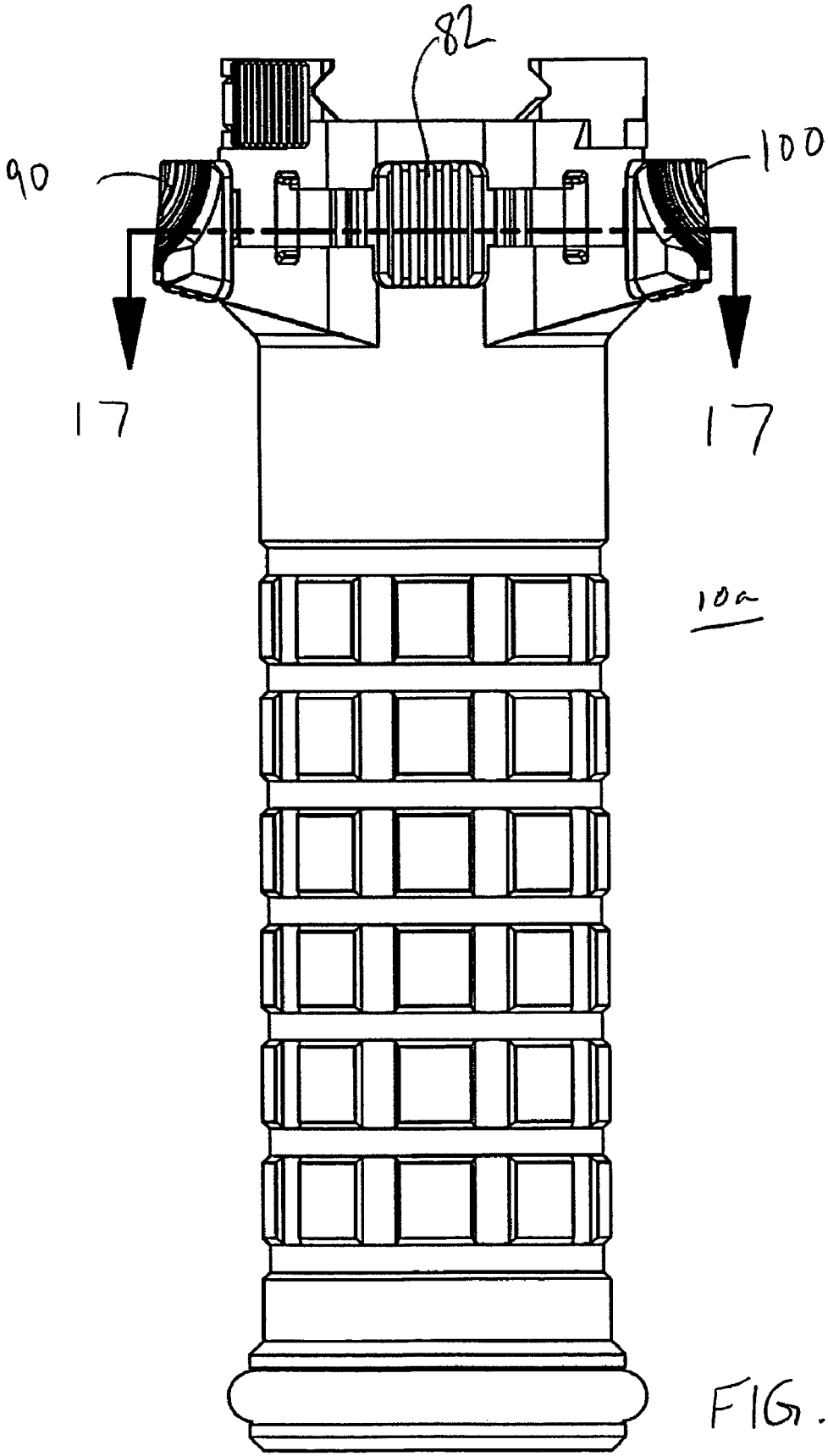
FIG. 16 is a front elevational view of the handgrip embodiment appearing in FIG. 14, with the bipod assembly shown in the stored position.

First and second device connector cables 110 and 112, respectively, are electrically coupled to the circuit board 40 via conductor cabling 111 and include electrical connectors 114 and 116, respectively, for electronic coupling to a respective one of electronic accessory devices 120, 122 (see FIGS. 12 and 13). In the depicted embodiment, the electronic devices 120 and 122 may advantageously be a laser device such as a laser sighting device and a light source for target illumination, such as tactical flashlight.

A schematic diagram showing an exemplary switch circuit when the selector 82 is in the central position is illustrated in FIG. 12. In operation, when the selector 82 is moved into alignment with the switch S-1, the switch S-1 is closed and the switch S-3 is opened and either one of the left actuator 90 and the right actuator 100 may be employed to selectively actuate the first device 120. When the selector 82 is moved into alignment with the switch S-2, either one of the left actuator 90 and the right actuator 100 may be employed to selectively actuate the second device 122. In this manner, the selected device may be actuated in like fashion by both left- and right-handed marksmen. In the embodiment depicted in FIG. 12, the left and right actuators 90 and 100 and aligned switches S-4 and S-5, respectively, are inoperative to select either of the devices 120 or 122 when the selector 82 is moved into the center position to close the switch S-3 and open the switches S-1 and S-2.

Figure 17:
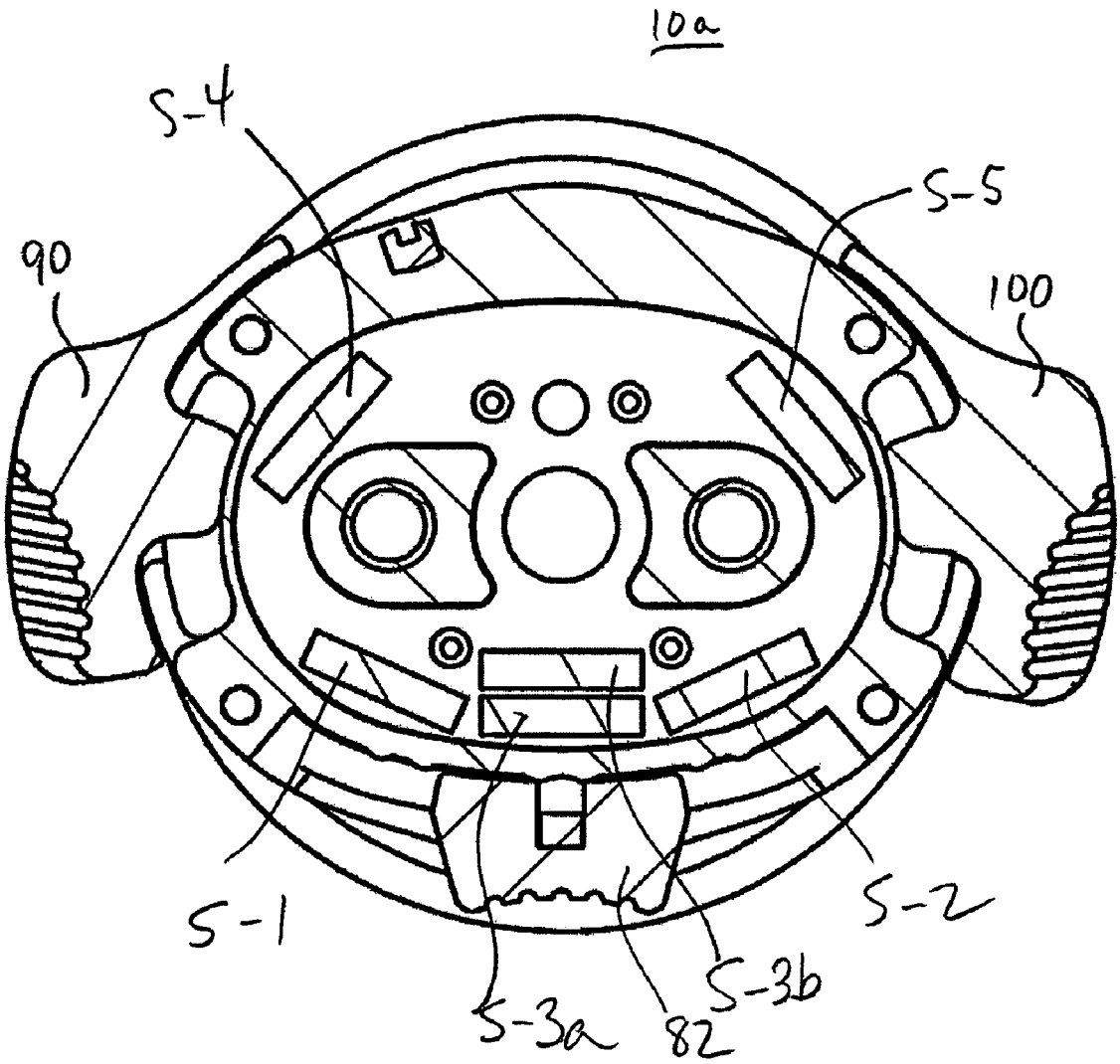
FIG. 17 is a plan cross-sectional view taken along the lines 17-17 in FIG. 16.
Figure 18:
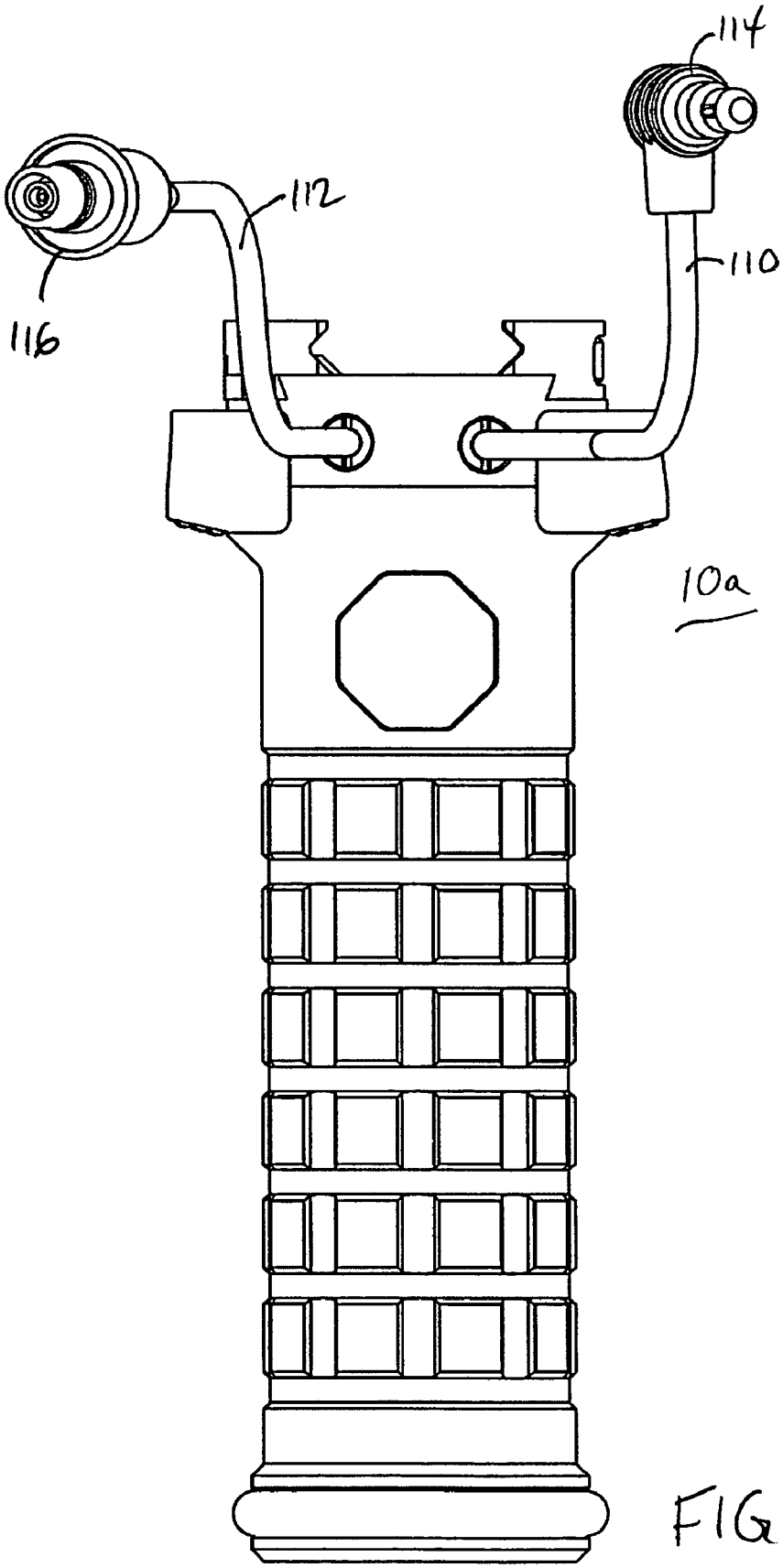
FIG. 18 is a rear elevational view of the handgrip embodiment appearing in FIG. 14, with the bipod assembly shown in the stored position.
Figure 19:
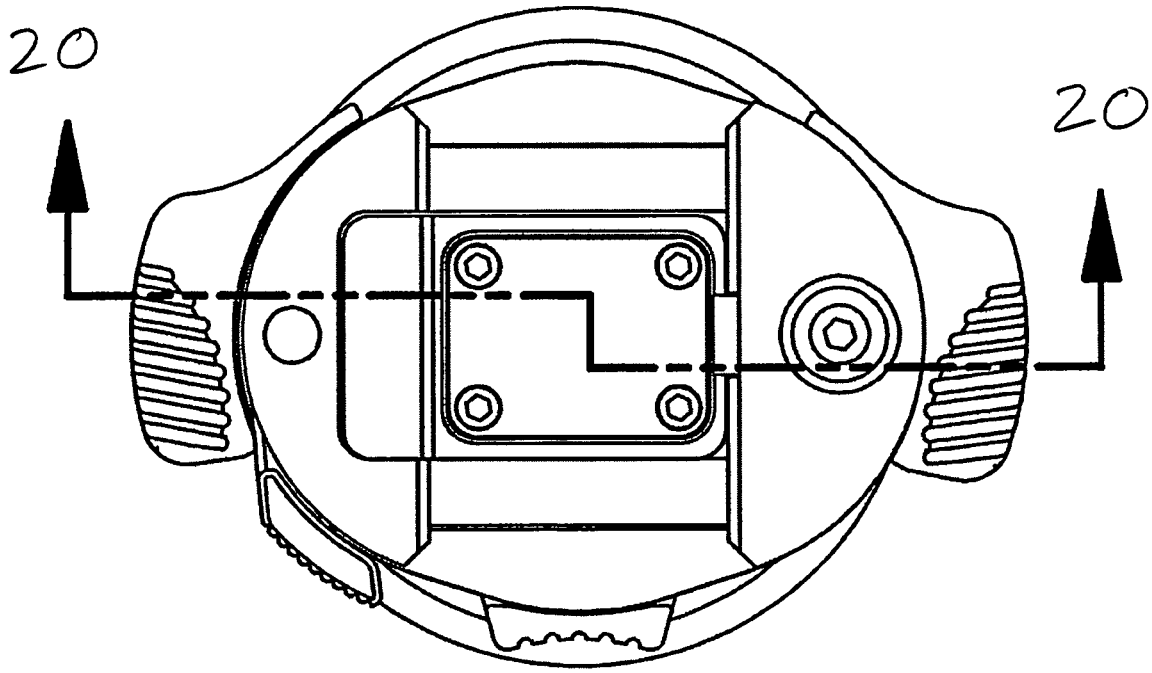
FIG. 19 is a top plan view of the embodiment shown in FIG. 14, with the bipod leg assembly in the retracted position.
Figure 20:
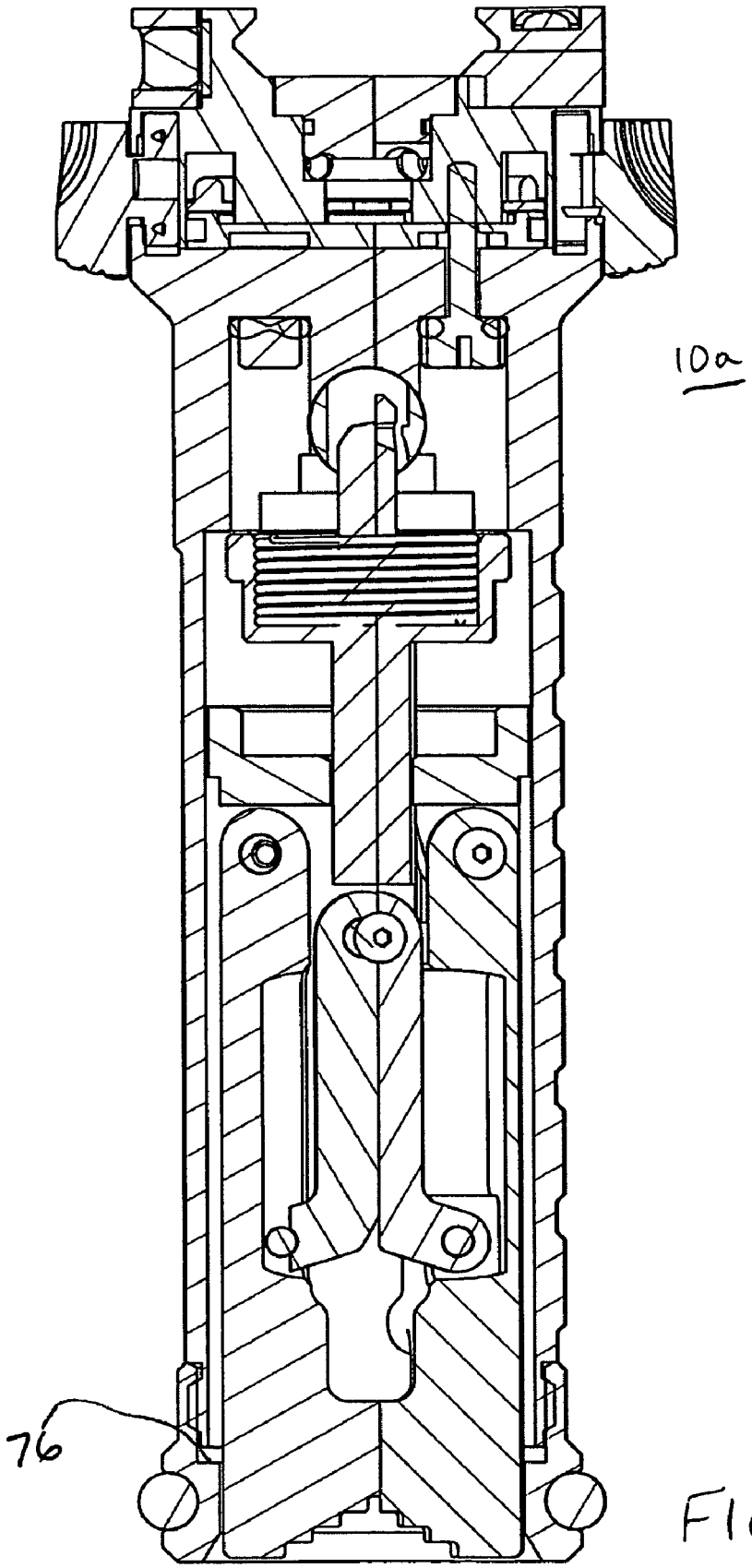
FIG. 20 is a side cross-sectional view taken along the lines 20-20 in FIG. 19.
Figure 21:
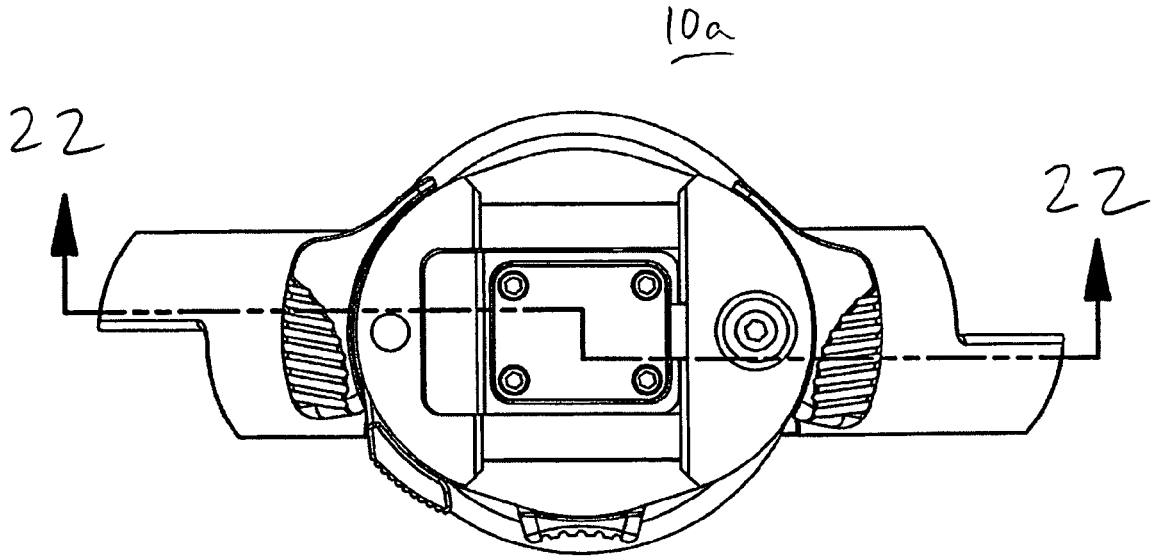
FIG. 21 is a top plan view of the embodiment shown in FIG. 14, with the bipod leg assembly in the extended position.
Figure 22:
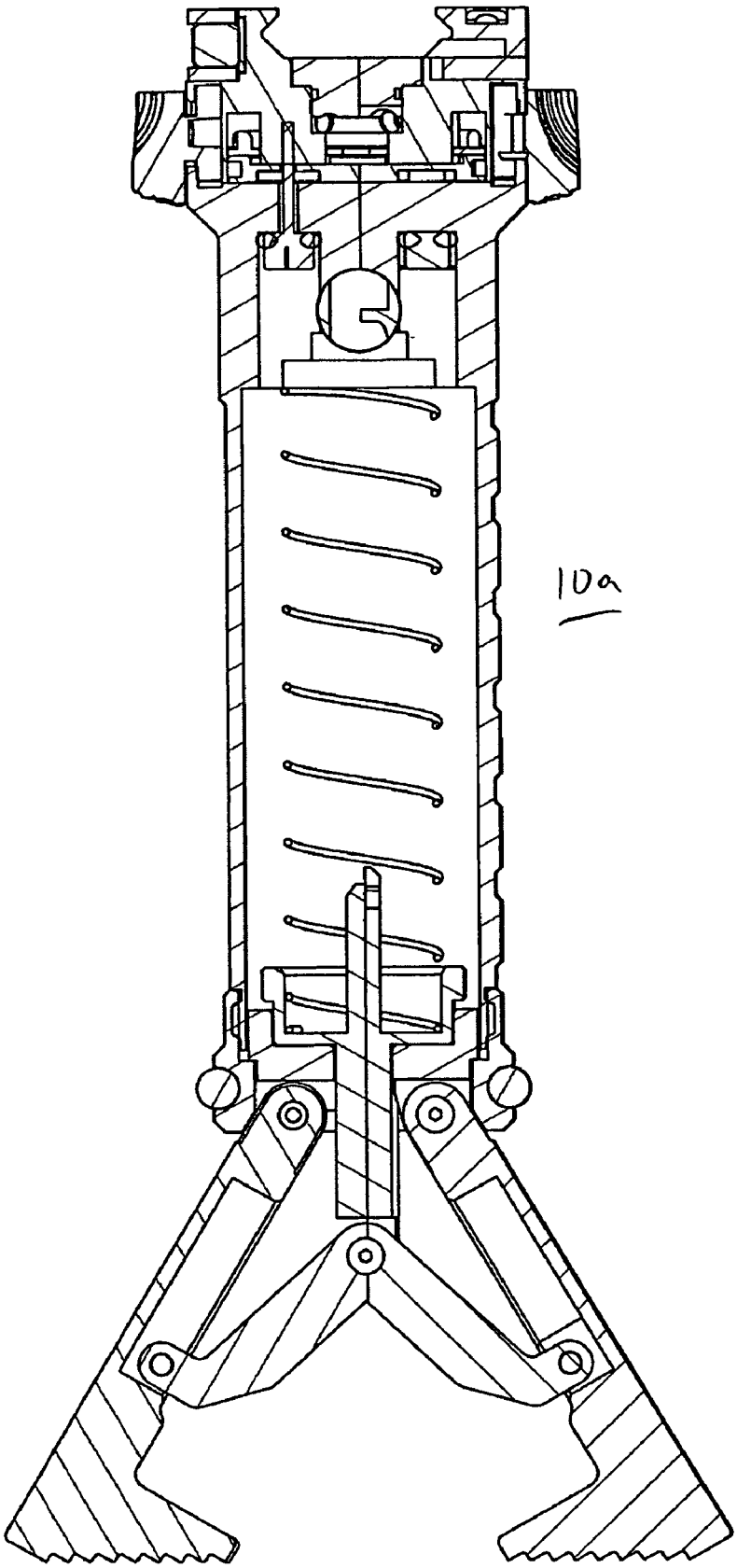
FIG. 22 is a side cross-sectional view taken along the lines 22-22 in FIG. 21.
Figure 23:
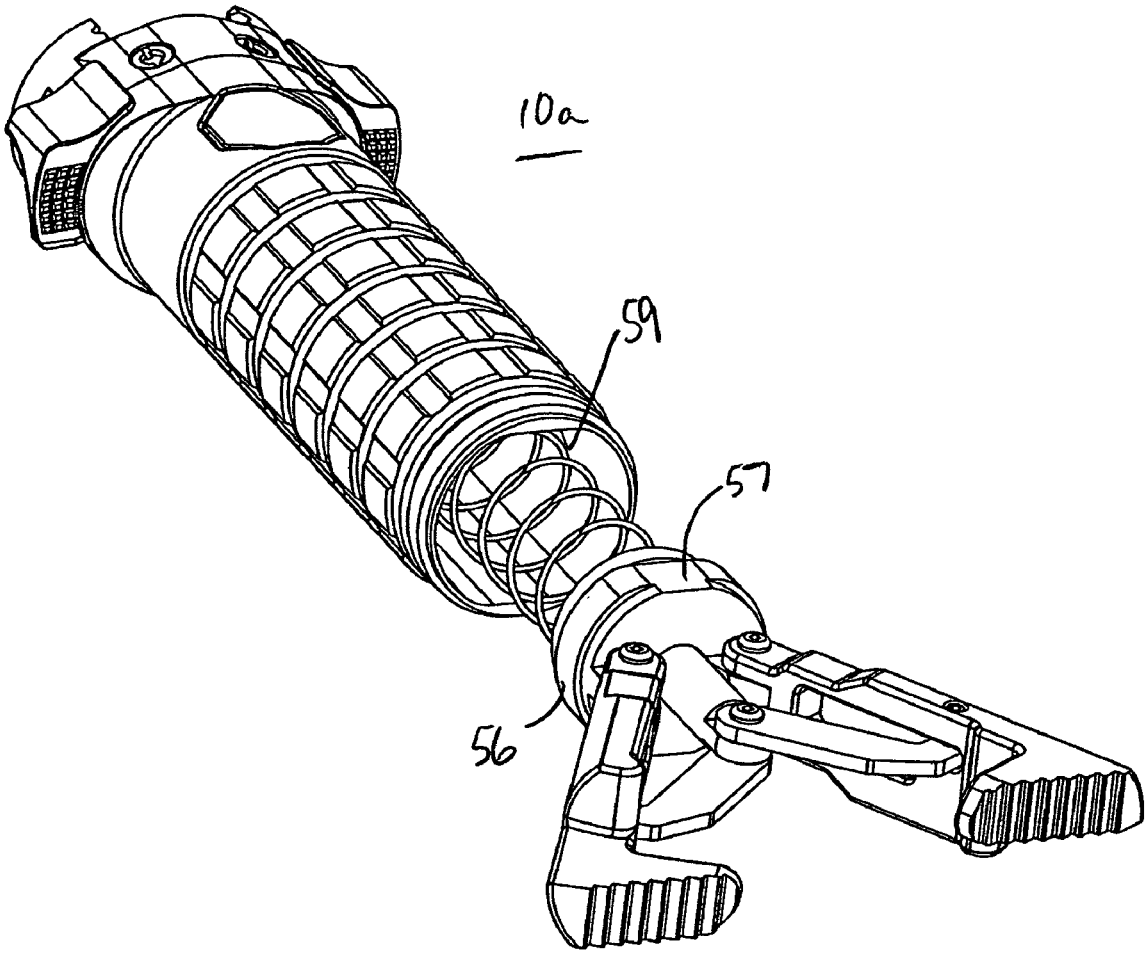
FIG. 23 is a partially exploded perspective view of the FIG. 14 embodiment illustrating a preferred means for limiting rotation of the bipod leg assembly relative to the handgrip housing.
Figure 24:
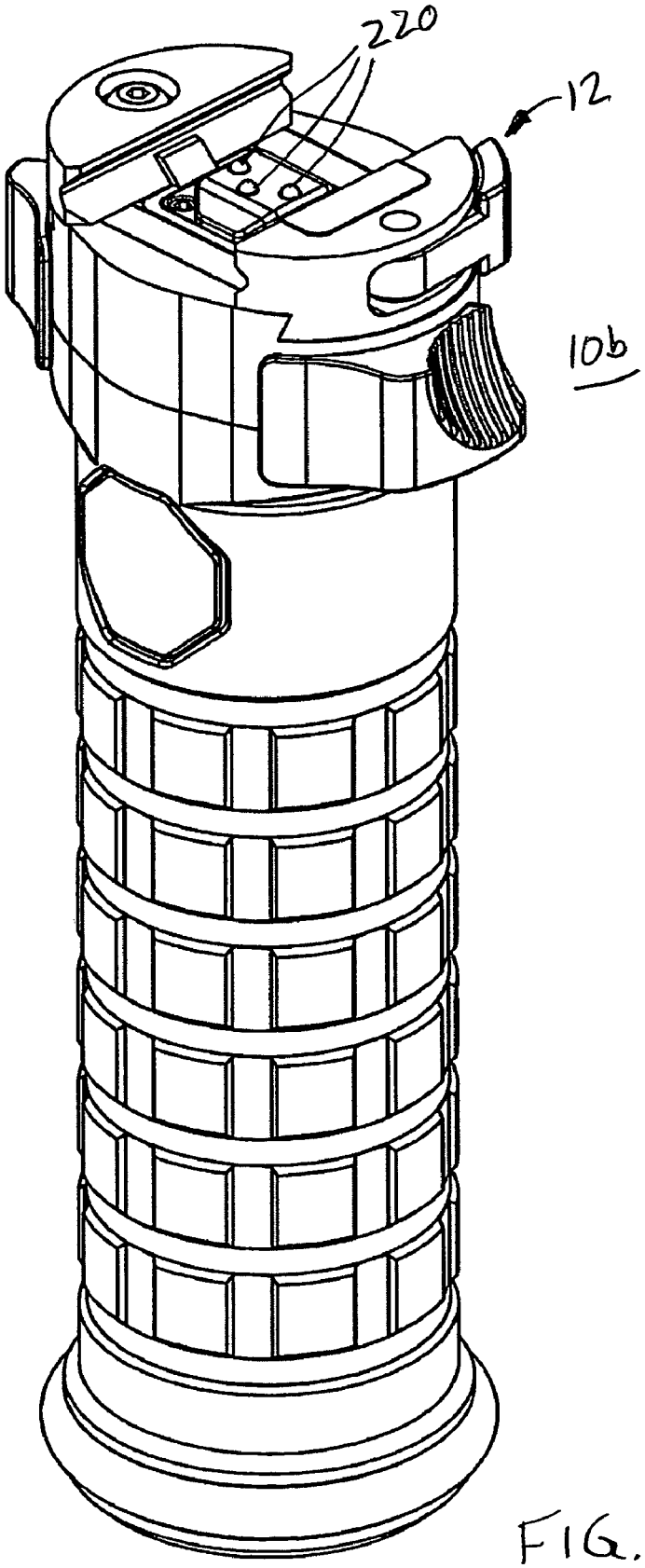
FIG. 24 is a perspective view of a removable handgrip according to a third exemplary embodiment of the present invention.
Figure 25:
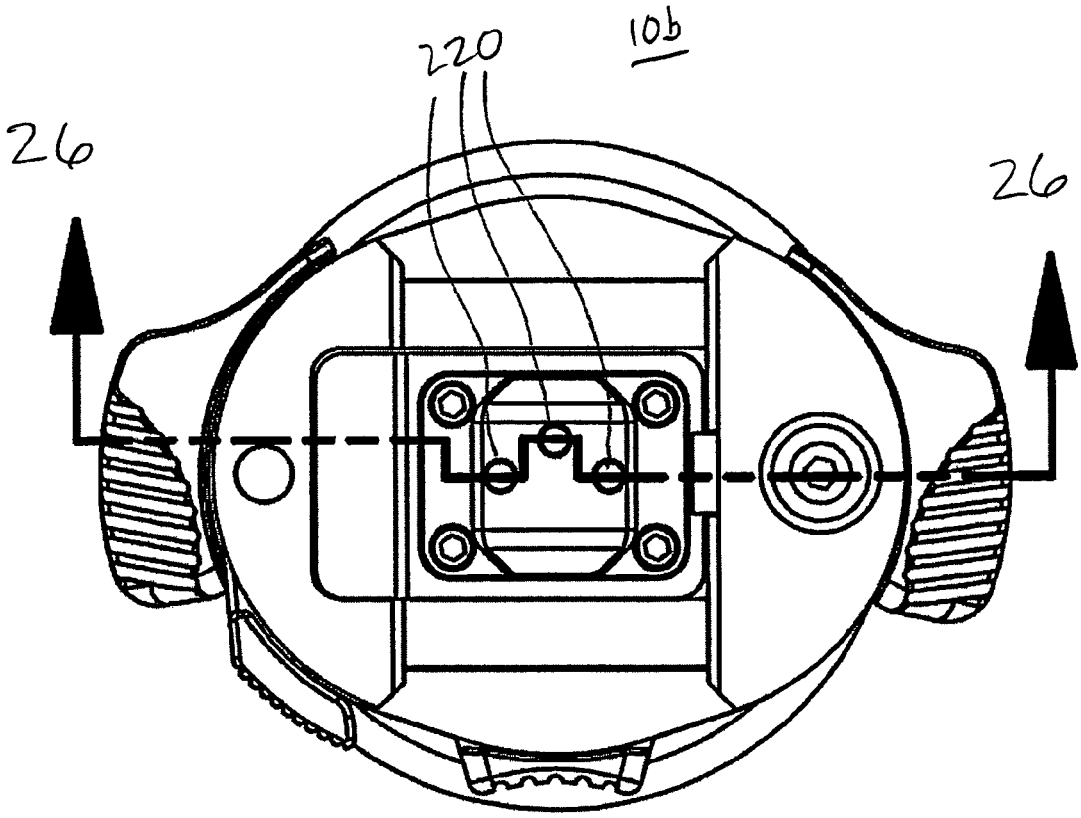
FIG. 25 is a top plan view of the embodiment shown in FIG. 24, with the legs in the retracted position.
Figure 26:
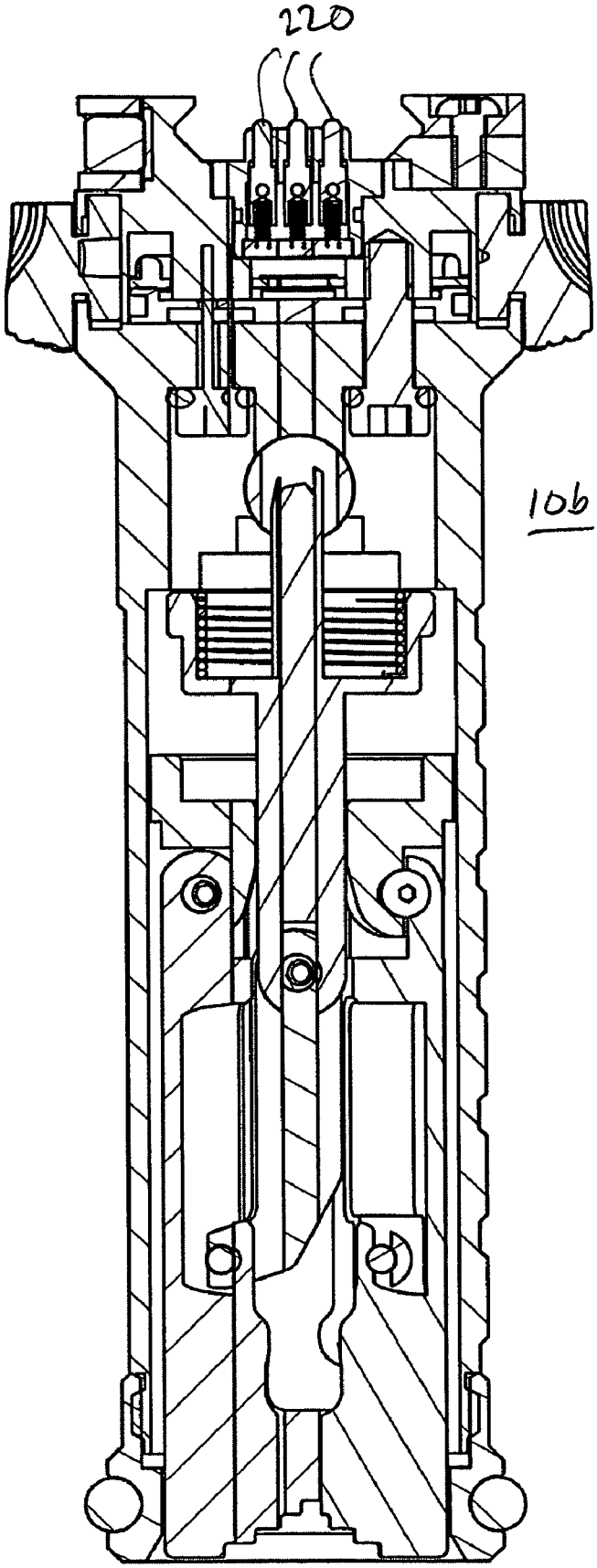
FIG. 26 is a side cross-sectional view taken along the lines 26-26 in FIG. 25.
Figure 27:
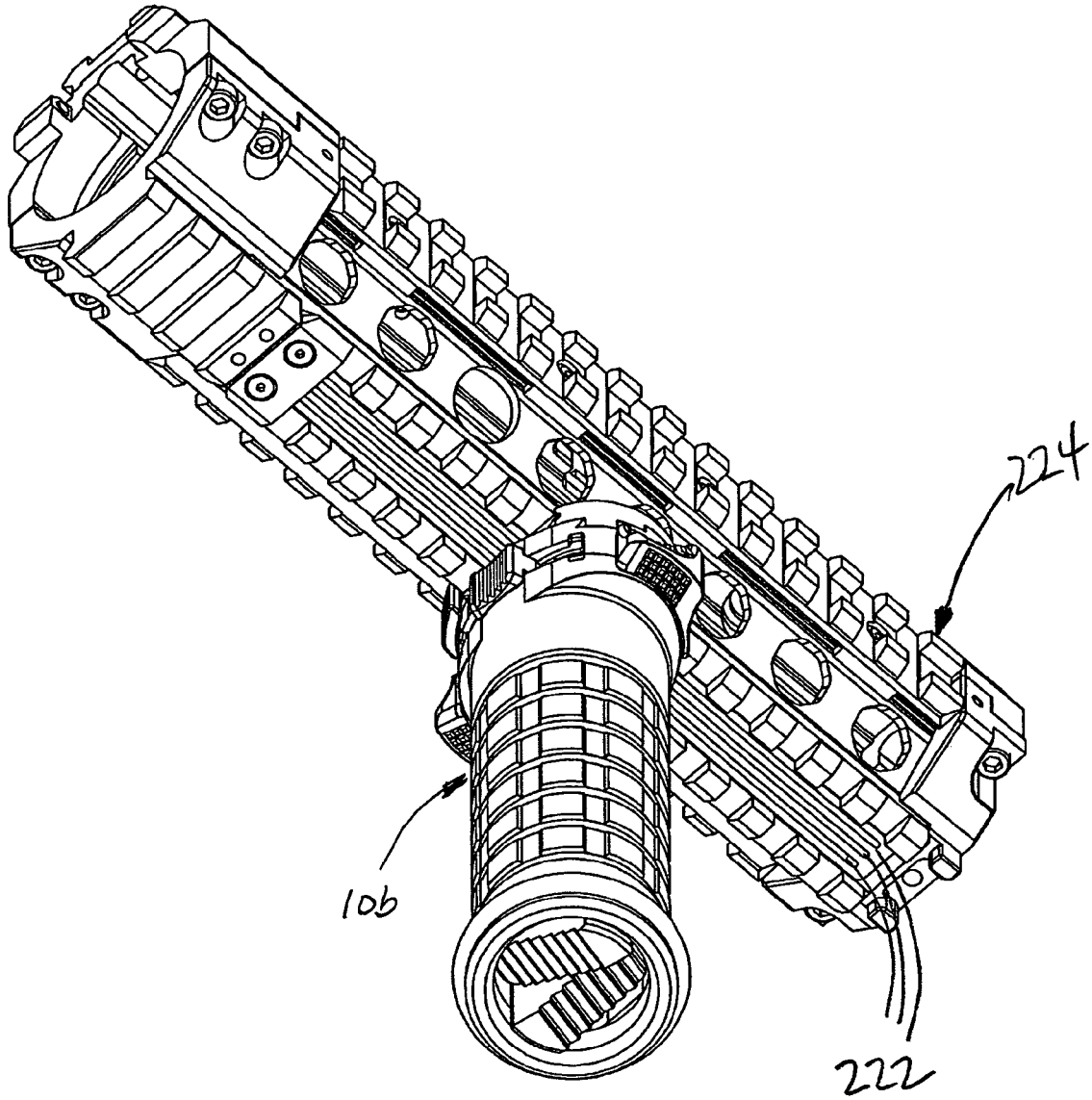
FIG. 27 is a bottom perspective view of a handgrip attached to a weapon rail interface.

In an alternative, preferred embodiment, illustrated in FIGS. 13 and 17, the single switch S-3 of the FIG. 12 embodiment is replaced with two reed switches S-3*a* and S-3*b*, which are normally open and which are both closed by the proximity of the magnet 84 when the selector 82 is in the central position. In operation, when the selector 82 is moved into alignment with the switch S-1, the switches S-3*a* and S-3*b* are opened and the switch S-1 is closed. Either one of the left actuator 90 and the right actuator 100 may then be employed to selectively actuate the first device 120. When the selector 82 is moved into alignment with the switch S-2, the switches S-3*a* and S-3*b* are opened and either one of the left actuator 90 and the right actuator 100 may be employed to selectively actuate the second device 122, as described above. In the embodiment depicted in FIG. 13, each of the left and right actuators 90 and 100 and aligned switches S-4 and S-5, respectively, are operative to simultaneously actuate both of the devices 120 and 122 when the selector 82 is moved into the central position to open the switches S-1 and S-2 and to close the switches S-3*a* and S-3*b*. It will be recognized that myriad other switch is configurations may be employed.

Referring now to FIGS. 14-23, a handgrip apparatus 10*a* includes a weapon mount or interface member 12 adapted to be removably mounted to a Picatinny rail interface. The interface member 12 includes a lever 200 pivoting about a pivot pin 202 and having a cam surface 204 that bears against a rail grabber 206 for securing the handgrip to a rail interface. Alternative mounting systems as described above are also contemplated.

The handgrip 10*a* additionally includes a handgrip housing 34 and may include handgrip features 36 on its external surface, such as circumferential grooves, ridges, knurls, or other handgrip features on its external surface. Also, the housing 34 may be textured, e.g., via sandblasting, to improve grip. Optionally, finger recesses and/or a soft or resilient material (not shown) to improve the user's grasp may be provided on the exterior surface of the housing 34.

The handgrip housing 34 may be generally tubular and is open at the bottom end. The housing is substantially closed at or near the upper end and defines a cavity 38 at the upper end for receiving a circuit board 40, carrying one or more switches as detailed above. The circuit board is received in a sealing plate 42 having a sealing gland or ring 44 received about the periphery thereof.

Threaded fasteners 46 pass through aligned openings 37 in the base of the cavity 38 and corresponding aligned openings in the sealing plate 42 and the circuit board 40 and rotatably engage aligned threaded openings 48 in the interface member 12 to secure the handgrip housing 34 thereto. Sealing rings 50 may be provided to prevent ingress of moisture via the openings 37.

A collapsible leg assembly 52 is received within the housing 34 and may be as described above by way of reference to FIGS. 1-10. Alternative leg assemblies, such as the leg assembly of FIG. 11 are also contemplated.

An end cap or base ring 74 is attached to the lower end of the housing 34, for example via internal threads rotatably engaging external threads formed on the housing 34 or other fastener. The end cap includes an inwardly extending lip or shoulder 76 which engages the piston 56 and stops the downward motion thereof when the leg assembly 52 is extended. An O-ring 75 may disposed about the base ring 74.

To retract the bipod legs 54, the legs are simply collapsed and reinserted into the housing 34, against the bias of the spring 68, wherein the hook 66 engages the latch member 64. The legs 54 in the depicted embodiment include inverted feet 78, which allow the legs 54 and feet 78 to be completely received within the housing 34. Alternatively, pivoting feet may be attached to the legs, for example, as described in the aforementioned Ser. No. 11/084,942.

In the depicted preferred embodiment, the piston 56 and the interior axial wall of the housing 34 are shaped or keyed, e.g., via aligned complimentary features 57 and 59, respectively, to prevent and/or limit the rotation of the leg assembly 52 relative to the housing 34, as described above, to ensure proper orientation of the leg assembly 52 relative to the housing and/or permit some degree of rotation of the leg assembly relative to the housing 34.

Alternatively, a circular piston 56 and housing interior shape may be provided and the relative rotation therebetween may be limited to a desired range via the placement of internal stop members, e.g., as described in the aforementioned Ser. No. 11/084,942.

The depicted preferred handgrip embodiment 10*a* includes integrated switches which may be used to actuate or control one or more electronic devices, such as one or more electronic devices or accessories mounted on the weapon. However, in alternative embodiments, the integrated switches may be omitted. In still other embodiments, such switches may be exteriorly mounted on the handgrip housing 34, for example, as shown and described in the aforementioned Ser. No. 11/084,942.

The circuit board 40 includes a plurality of switches, such as S-1-S-5 as detailed above with respect to FIG. 12 or 13. A device selector 82 and left and right actuators 90 and 100, respectively, as detailed above may be provided for actuating one or more weapon-mounted accessories.

First and second device connector cables 110 and 112, is respectively, are electrically coupled to the circuit board 40 via conductor cabling 111 and include electrical connectors 114 and 116, respectively, for electronic coupling to a respective electronic accessory device.

Referring now to FIGS. 24-27, there appears a third embodiment hand grip device 10*b*, which is as described above by way of reference to the device 10*a*, but wherein the electronic connectors 114 and 116 and cables 110 and 112 are omitted and replaced with electrical contacts 220 in the interface member 12. The contacts 220 engage conductors 222 formed on the weapon rail interface 224. The conductors 222, in turn, are electrically coupled to the accessory device or devices to be operated. The handgrip device 10*b* may be used with a circuit-carrying rail interface system as described in U.S. provisional application No. 60/879,923, filed on Jan. 11, 2007, the entire contents of which are herein incorporated by reference.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. A handgrip apparatus for firearm, comprising:

a hollow housing having a longitudinal axis and defining a handgrip surface and forming an enclosure;

a fastener connected to the housing, said fastener for removably attaching the handgrip apparatus to a fore-end portion of a firearm;

a retractable leg assembly movable between a retracted position and an extended position, said leg assembly including a pair of pivoting legs usable as a bipod support when the leg assembly is in the extended position;

said leg assembly axially rotatable relative to said hollow housing about the longitudinal axis of said hollow housing;

one or more switches coupled to the handgrip apparatus, said one or more switches for controlling the operation of one or more electronic devices; and one or more connectors electrically coupled to said one or more switches and adapted to be electrically coupled to the one or more electronic devices.

2. The handgrip apparatus of claim 1, further comprising:

one or more actuators coupled to said housing and configured for operator manipulation, wherein operator manipulation of said one or more actuators manipulates said one or more switches to selectively actuate at least one of the one or more electronic devices.

3. The handgrip apparatus of claim 2, further comprising:

said one or more actuators including a first actuator positioned at a first location on said handgrip to accommodate a right-handed operator and a second actuator positioned at a second location on said handgrip to accommodate a left-handed operator, wherein operator manipulation of either or both of said first and second actuators actuates at least one of said one or more electronic devices.

4. The handgrip apparatus of claim 1, further comprising:

one or more selectors coupled to said housing and configured for operator manipulation;

one or more actuators coupled to said housing and configured for operator manipulation; and wherein operator manipulation of said one or more selectors and said one or more actuators in combination manipulates said one or more switches to selectively actuate at least one of a plurality of electronic devices electrically coupled to said one or more switches and remotely located with respect to the handgrip apparatus.

5. The handgrip apparatus of claim 4, wherein said one or more switches, said one or more selectors, and said one or more actuators are integral with the handgrip apparatus.

6. The handgrip apparatus of claim 4, further comprising:

said one or more switches mounted within an interior portion of said handgrip apparatus.

7. The handgrip apparatus of claim 6, further comprising:

said one or more switches including one or more magnetically-actuated switches; and each of said one or more selectors and said one or more actuators carrying a magnet and movable to manipulate said one or more magnetically actuated switches.

8. The handgrip apparatus of claim 7, wherein said one or more magnetically actuated switches include one or more magnetic reed switches.

9. The handgrip apparatus of claim 1, further comprising:

a latch assembly for releasably securing the leg assembly in the retracted position.

10. The handgrip apparatus of claim 9, further comprising:

a depressible latch release actuator to allow said leg assembly to be moved to the extended position; and spring means in said housing for urging said leg assembly to said extended position when said latch release actuator is depressed.

11. The handgrip apparatus of claim 10, further comprising:

an axially movable member coupling said latch assembly to said leg assembly, said axially movable member movable in an axial direction when the leg assembly is moved between the retracted and extended positions.

12. The handgrip apparatus of claim 11, further comprising:

a pair of spreader arms, each of said spreader arms pivotally attached at a first end to said axially movable member and pivotally attached at a second end opposite the first end to a respective one of said legs.

13. The handgrip apparatus of claim 1, further comprising:

means for limiting a degree relative rotation between said housing and said leg assembly.

14. The handgrip apparatus of claim 1, further comprising:

each of said one or more electrical connectors adapted for coupling said one or more switches to a weapon-mounted electronic device.

15. The handgrip apparatus of claim 14, further comprising:

a first electrical connector adapted to couple said one or more switches to a laser sight module; and a second electrical connector adapted to couple said one or more switches to an illumination light source.

16. The handgrip apparatus of claim 1, wherein said fastener is adapted for removable attachment to a Picatinny rail interface.

17. A handgrip apparatus for firearm, comprising:

a hollow housing defining a handgrip surface and forming an enclosure;

a fastener connected to the housing, said fastener for removably attaching the handgrip apparatus to a fore-end portion of a firearm;

a retractable leg assembly movable between a retracted position and an extended position, said leg assembly including a pair of pivoting legs usable as a bipod support when the leg assembly is in the extended position;

one or more switches coupled to the handgrip apparatus, said one or more switches for controlling the operation of one or more electronic devices;

one or more connectors electrically coupled to said one or more switches and adapted to be electrically coupled to the one or more electronic devices;

electrical contacts disposed on said fastener and electrically coupled to said one or more switches; and said electrical contacts adapted to contact a circuit carried on a firearm rail interface when said fastener is operatively connected to the firearm rail interface.

18. The handgrip apparatus of claim 1, further comprising:

a first switch coupled to said housing and configured for operator manipulation, wherein operator manipulation of said first switch actuates a first electronic device, said first electronic device remotely located with respect to said handgrip apparatus; and a second switch coupled to said housing and configured for operator manipulation, wherein operator manipulation of said second switch actuates a second electronic device, said second electronic device remotely located with respect to said handgrip apparatus.

19. A handgrip apparatus for firearm, comprising:

a hollow housing defining a handgrip surface and forming an enclosure;

a fastener connected to the housing, said fastener for removably attaching the handgrip apparatus to a fore-end portion of a firearm;

a retractable leg assembly movable between a retracted position and an extended position, said leg assembly including a pair of pivoting legs usable as a bipod support when the leg assembly is in the extended position;

one or more switches coupled to the handgrip apparatus, said one or more switches for controlling the operation of one or more electronic devices;

one or more connectors electrically coupled to said one or more switches and adapted to be electrically coupled to the one or more electronic devices; and said fastener pivotally connected to said housing, said housing selectively pivotally movable between a first position in which said housing extends generally perpendicular to the fore-arm portion of the firearm and a second position in which said housing extends generally parallel to the fore-arm portion of the firearm when said fastener is operatively connected to the fore-arm portion of the firearm.

20. A handgrip apparatus for firearm, comprising:

a hollow housing defining a handgrip surface and forming an enclosure;

a fastener pivotally connected to the housing, said fastener for removably attaching the handgrip apparatus to a fore-end portion of a firearm; and a retractable leg assembly movable between a retracted position and an extended position, said leg assembly including a pair of pivoting legs usable as a bipod support when the leg assembly is in the extended position.

21. The handgrip apparatus of claim 20, further comprising:

one or more switches coupled to the handgrip apparatus;

one or more connectors electrically coupled to said one or more switches and adapted to be electrically coupled to one or more electronic devices; and said one or more switches for controlling the operation of one or more electronic devices.

* * * * *